US009311913B2

(12) United States Patent
Legat

(10) Patent No.: US 9,311,913 B2
(45) Date of Patent: Apr. 12, 2016

(54) ACCURACY OF TEXT-TO-SPEECH SYNTHESIS

(71) Applicant: Nuance Communications, Inc., Burlington, MA (US)

(72) Inventor: Milan Legat, Zurich (CH)

(73) Assignee: Nuance Communications, Inc., Burlington, MA (US)

( * ) Notice: Subject to any disclaimer, the term of this patent is extended or adjusted under 35 U.S.C. 154(b) by 543 days.

(21) Appl. No.: 13/759,924

(22) Filed: Feb. 5, 2013

(65) Prior Publication Data

US 2014/0222415 A1 Aug. 7, 2014

(51) Int. Cl.
*G10L 13/00* (2006.01)
*G10L 13/08* (2013.01)

(52) U.S. Cl.
CPC ..... *G10L 13/08* (2013.01); *G10L 13/086* (2013.01)

(58) Field of Classification Search
CPC ..... G10L 13/08
See application file for complete search history.

(56) References Cited

U.S. PATENT DOCUMENTS 5,832,433 A * 11/1998 Yashchin et al. ..... 704/260
6,076,060 A * 6/2000 Lin et al. ..... 704/260
6,078,885 A * 6/2000 Beutnagel ..... 704/258
6,081,780 A * 6/2000 Lumelsky ..... 704/260
6,208,968 B1 * 3/2001 Vitale et al. ..... 704/260
6,411,932 B1 * 6/2002 Molnar et al. ..... 704/260
6,826,530 B1 * 11/2004 Kasai et al. ..... 704/258
6,879,957 B1 * 4/2005 Pechter et al. ..... 704/267
7,165,032 B2 * 1/2007 Bellegarda ..... 704/258
7,472,061 B1 * 12/2008 Alewine ..... G10L 13/08 704/243
8,898,066 B2 * 11/2014 Li ..... 704/258
2002/0184027 A1 * 12/2002 Brittan et al. ..... 704/258
2005/0182630 A1 * 8/2005 Miro ..... G10L 13/08 704/269
2006/0031069 A1 * 2/2006 Huang et al. ..... 704/243
2007/0016421 A1 * 1/2007 Nurminen et al. ..... 704/260
2007/0118377 A1 * 5/2007 Badino ..... G10L 13/08 704/260
2007/0150279 A1 * 6/2007 Gandhi et al. ..... 704/258
2007/0233490 A1 * 10/2007 Yao ..... 704/260
2007/0239455 A1 * 10/2007 Groble et al. ..... 704/260
2007/0255567 A1 * 11/2007 Bangalore ..... G06F 17/2735 704/260

(Continued)

OTHER PUBLICATIONS

Bisani, Maximilian, and Hermann Ney. "Joint-sequence models for grapheme-to-phoneme conversion." Speech Communication 50.5 (2008): 434-451.*

Yvon, François, et al. "Objective evaluation of grapheme to phoneme conversion for text-to-speech synthesis in French." Computer Speech & Language 12.4 (1998): 393-410.*

(Continued)

*Primary Examiner* — Brian Albertalli
(74) *Attorney, Agent, or Firm* — Banner & Witcoff, Ltd.

(57) ABSTRACT

According to a first example configuration, a pair of text-to-speech synthesizers produces audio representations for each of multiple words. The outputs are compared to identify instances in which a lexicon lookup algorithm and a grapheme-to-phoneme algorithm produce different audio representations for the same words. Results of the analysis are used to train a classifier that subsequently determines a degree to which a grapheme-to-phoneme algorithm is likely to detect a newly detected out-of-vocabulary word to be converted into an audio representation. According to a second example configuration, a text analyzer tags a non-standard word. A group of reviewers generate one or more proposed text-to-speech expansion rules for a detected non-standard word. When there is a high amount of agreement amongst the reviewers how to expand the non-standard word, the proposed expansion rule is published for use by respective one or more text-to-speech synthesizers.

20 Claims, 12 Drawing Sheets

(56) References Cited

U.S. PATENT DOCUMENTS

| | | | | |
|---|---|---|---|---|
| 2008/0183473 | A1* | 7/2008 | Nagano et al. | 704/258 |
| 2009/0006097 | A1* | 1/2009 | Etezadi et al. | 704/260 |
| 2009/0240501 | A1* | 9/2009 | Chen et al. | 704/260 |
| 2010/0082349 | A1* | 4/2010 | Bellegarda et al. | 704/260 |
| 2010/0312564 | A1* | 12/2010 | Plumpe | 704/260 |
| 2012/0136664 | A1* | 5/2012 | Beutnagel | G10L 13/00 704/260 |
| 2013/0080173 | A1* | 3/2013 | Talwar et al. | 704/260 |
| 2013/0132069 | A1* | 5/2013 | Wouters et al. | 704/8 |
| 2013/0179170 | A1* | 7/2013 | Cath et al. | 704/260 |
| 2014/0067400 | A1* | 3/2014 | Yamazaki, Michihiro | 704/260 |
| 2014/0122081 | A1* | 5/2014 | Kaszczuk et al. | 704/260 |

OTHER PUBLICATIONS

Damper, Robert I., et al. "Evaluating the pronunciation component of text-to-speech systems for English: A performance comparison of different approaches." Computer Speech and Language 13.2 (1999): 155-176.*

Ribeiro, Ricardo Daniel Santos Faro Marques, Luís C. Oliveira, and Isabel Trancoso. "Morphosyntactic Disambiguation for TTS Systems." LREC. 2002.*

Hixon, Ben, Eric Schneider, and Susan L. Epstein. "Phonemic Similarity Metrics to Compare Pronunciation Methods." Interspeech. 2011.*

* cited by examiner

F = FOUND IN LEXICON

NF = NOT FOUND IN LEXICON

HPM = HIGH PROBABILTY OF MISPRONUNCIATION

LPM = LOW PROBABILTY OF MISPRONUNCIATION

| 205-1 | THE | SPANISH | WORD | COCINA | MEANS | KITCHEN | IN | ENGLISH |
|---|---|---|---|---|---|---|---|---|
| PRIMARY TTSS 210-1 | F | F | F | NF HPM | F | F | F | F |
| SECONDARY TTSS 210-2 | NF | NF | NF | F | NF | NF | NF | NF |
| ⋮ | ⋮ | ⋮ | ⋮ | ⋮ | ⋮ | ⋮ | ⋮ | ⋮ |

FIG. 3

F = FOUND IN LEXICON

NF = NOT FOUND IN LEXICON

HPM = HIGH PROBABILTY OF MISPRONUNCIATION

LPM = LOW PROBABILTY OF MISPRONUNCIATION

| 205-1 | WE | ARE | TAKING | A | GREYCATION | IN | DISNEY |
|---|---|---|---|---|---|---|---|
| PRIMARY TTSS 210-1 | F | F | F | F | NF LPM | F | F |
| SECONDARY TTSS 210-2 | NF | NF | NF | NF | NF | NF | NF |
| ⋮ | ⋮ | ⋮ | ⋮ | ⋮ | ⋮ | ⋮ | ⋮ |

FIG. 4

ACCURACY OF TEXT-TO-SPEECH SYNTHESIS

BACKGROUND

Conventional text-to-speech synthesizers can be used to convert text into corresponding audio. For example, a text-to-speech synthesizer can receive a set of text to be converted into corresponding audio. Depending on a respective configuration, the text-to-speech synthesizer can implement any number of different conventional algorithms to convert the received set of text into corresponding equivalent audio.

One conventional algorithm to convert text into audio output symbol representation is a so-called lexicon lookup. The lexicon lookup can include a complete listing of words and/or morphemes (e.g., subparts of words) for a particular language. Each of the words and/or morphemes in the lexicon lookup maps to a corresponding audio output symbol representation equivalent. Via a conventional lexicon lookup for each word in a received set of text, a text-to-speech synthesizer produces a proper audio output symbol representation output.

Typically, a conventional text-to-speech synthesizer is able to perform a lexicon lookup for most words in a received set of text. However, certain words that are not found during the lexicon lookup are called out-of-vocabulary words. Out-of-vocabulary words represent words in which the text-to-speech synthesizer is less certain how to generate a proper audio output symbol representation equivalent.

Another conventional algorithm that can be used by a respective text-to-speech synthesizer to convert text is a so-called grapheme-to-phoneme or G2P algorithm. G2P refers to grapheme-to-phoneme conversion. In general, this is the process of using grapheme-to-phoneme rules to generate a pronunciation for received text. Grapheme-to-phoneme rules can be created by automated statistical analysis of a pronunciation dictionary.

Conventional grapheme-to-phoneme algorithms can be used to generate a most probable sound for words (e.g., so-called out-of-vocabulary words) that are not found by a lexicon lookup algorithm. As mentioned above, lexicon lookup and corresponding generation of audio output symbol representation for a word is preferred because it is typically quite accurate. Generation of an audio output symbol representation for an out-of-vocabulary word using a grapheme-to-phoneme algorithm is typically much less accurate and may be incorrect as use of the grapheme-to-phoneme algorithm is merely based on best efforts. In other words, the grapheme-to-phoneme algorithm does its best to produce a proper pronunciation of a given word, although the resulting output may be inaccurate.

Text-to-speech synthesis can also include so-called text normalization. Conventional text normalization includes transforming text into a single canonical form. Normalizing text before storing or processing it allows for separation of concerns, since the input is guaranteed to be consistent before operations are performed on it. Typically, text normalization in text-to-speech applications requires being aware of what type of text is to be normalized and how the text is to be expanded upon text-to-speech conversion. As a more specific example, the word "vi" may have different meanings in different contexts. Text normalization involves tuning a text-to-speech synthesizer to produce a different audio out for this non-standard expression depending on a context in which it is used. A text-to-speech synthesizer may pronounce the textual word "vi" as "vie", "vee", or "sixth" depending on a textual context in which the expression is used.

BRIEF DESCRIPTION

Embodiment #1

Use of conventional techniques to convert text-to-speech can suffer from deficiencies. For example, via conventional techniques as mentioned, if a word to be converted into audio output symbol representation is not found in a lexicon lookup, then a grapheme-to-phoneme algorithm can be used to produce a best guess audio output symbol representation for the out-of-vocabulary word. However, in certain instances, even a grapheme-to-phoneme may not able to produce an accurate audio output symbol representation of the detected out-of-vocabulary word.

Embodiments herein deviate with respect to conventional techniques as discussed above to reduce a number of mispronounced out-of-vocabulary words during text-to-speech synthesis.

For example, in accordance with one embodiment, a text-to-speech analyzer resource can include multiple text-to-speech synthesizers operating in parallel. In one embodiment, the text-to-speech analyzer resource implements a lexicon lookup algorithm (e.g., an algorithm that includes a mapping of known words, sub-words, morphemes, etc., to corresponding audio output symbol representation) in first text-to-speech hardware to produce an audio output symbol representation for each word in a set of multiple words. The text-to-speech analyzer resource also simultaneously implements a grapheme-to-phoneme algorithm in second text-to-speech hardware to produce an audio output symbol representation for each word in the set of multiple words.

For each word in the set, the text-to-speech analyzer resource performs a comparison of a respective output (e.g., an audio output symbol representation or rendition of a word under test) of the first text-to-speech hardware (lexicon lookup) and a respective output (e.g., an audio output symbol representation or rendition of the word under test) from the second text-to-speech hardware (grapheme-to-phoneme).

In one embodiment, the output of the lexicon lookup is considered a standard in which the grapheme-to-phoneme algorithm is measured. In other words, the pronunciation of a text-based word using the lexicon lookup is considered to be correct. To this end, the text-to-speech analyzer comparator resource classifies each of the multiple words depending on the comparison.

For example, in one non-limiting embodiment, the text-to-speech comparator resource keeps track of which of the multiple words are pronounced the same and which of the words are pronounced differently as generated by the lexicon lookup algorithm and the grapheme-to-phoneme algorithm. That is, in one embodiment, the comparator resource generates a first class of words to include each respective word of the multiple words in which the lexicon lookup algorithm and the grapheme-to-phoneme algorithm produce a substantially same audio output symbol representation for the respective word; the comparator resource also generates a second class of words to include each respective word of the multiple words in which the lexicon lookup algorithm and the grapheme-to-phoneme algorithm produce a substantially different audio output symbol representation for the respective word.

A text-to-speech analyzer resource analyzes the second class of words including instances in which the grapheme-to-phoneme algorithm (e.g., second text-to-speech hardware) produces a different audio output symbol representation than the lexicon lookup algorithm (e.g., the first text-to-speech hardware). Such words in this class can be considered to be incorrectly pronounced. In accordance with further embodiments, the text-to-speech analyzer resource also can be configured to analyze the first class of words to produce predictors or training information.

In one embodiment, based on the analysis, the text-to-speech analyzer resource generates a set of predictors. The set of predictors can indicates circumstances in which use of the grapheme-to-phoneme rules results in generation of substantially different audio output symbol representations by the text-to-speech synthesizers. The text-to-speech analyzer resource utilizes the set of predictors to train a classification model.

In a more specific embodiment, the text-to-speech analyzer resource analyzes the subset of words to identify instances in which the grapheme-to-phoneme algorithm produces an improper audio output symbol representation for words in the lexicon lookup. The text-to-speech analyzer resource produces a set of predictor rules based on the instances in which the grapheme-to-phoneme produces an incorrect pronunciation.

In further embodiments, the text-to-speech analyzer resource then utilizes the set of predictor rules as a basis to train a classification model. In one embodiment, the classification model can be configured to detect or predict which out-of-vocabulary words in a text sample are likely to be mispronounced during text-to-speech synthesis of the text sample.

Subsequent to training or producing a classification model, the classification model is then used as a basis to determine whether a subsequently received out-of-vocabulary word can be synthesized into appropriate audio output symbol representation.

As an example, assume that a text-to-speech processing resource detects occurrence of an out-of-vocabulary word in a text sample to be converted into audio output symbol representation. A text-to-speech processing resource uses the classification model to estimate a probability that the detected out-of-vocabulary word will be mispronounced during text-to-speech synthesis.

Based on a magnitude of the probability, the text-to-speech processing resource can be configured to produce the audio output symbol representation to include an audio output symbol representation or rendition of the out-of-vocabulary word from any of one or more sources. For example, if the classification model indicates that there is a high probability that a grapheme-to-phoneme algorithm in a corresponding primary language can be used to generate a proper audio output symbol representation for an out-of-vocabulary word, then the text-to-speech system uses the grapheme-to-phoneme algorithm in the primary language to generate the audio output symbol representation for the out-of-vocabulary word.

In accordance with further embodiments, a source other than a primary language text-to-speech synthesizer (e.g., a grapheme-to-phoneme synthesizer) can be selected to generate an audio output symbol representation of the out-of-vocabulary word based at least in part on detecting that a magnitude of the probability that the grapheme-to-phoneme algorithm in a primary text-to-speech synthesizer will mispronounce the out-of-vocabulary word is above a threshold value. In other words, the classification model can indicate that it is highly likely that a particular out-of-vocabulary word will be mispronounced using grapheme-to-phoneme in the primary language based on the initial process of learning where the grapheme-to-phoneme as discussed above during the compare process.

A secondary text-to-speech synthesizer executed in parallel with the primary language text-to-speech synthesizer may be detect that the out-of-vocabulary word is present in a foreign language lexicon and can be properly pronounced in a secondary language (e.g., a foreign language). In such an instance, the text-to-speech synthesizer in the secondary language can be used to pronunciation the out-of-vocabulary word. Thus, if it is determined that an out-of-vocabulary word is a foreign language word, then the text-to-speech synthesizer in the foreign language can be used to produce an appropriate audio output symbol representation for the out-of-vocabulary word.

Yet further embodiments herein are directed to operating, for each of multiple languages, two TTS (Text-to-Speech) synthesizers in parallel in a manner as discussed above to train a so-called classifier for each respective language of multiple languages. For example, a first text-to-speech synthesizer in a pair uses a grapheme-to-phoneme algorithm to produce speech for sample text. A second text-to-speech synthesizer in the pair uses a lexicon lookup to produce speech for the sample text. In a similar manner as discussed above, the output of each of the text-to-speech synthesizers is then compared to train a classifier in that language. The classifier is able to determine whether a newly received sample word would likely be mispronounced or not in the particular language. In this manner, a classifier can be trained in each of the multiple languages using a respective pair of text-to-speech synthesizers. That is, via a comparison, each classifier is trained to detect whether a word is likely to be mispronounced or not in that language.

In one embodiment, a primary classifier (e.g., an English trained classifier or classification model) can be used as a basis to detect when a newly received candidate out-of-vocabulary word is likely to be mispronounced in the primary language. As mentioned, the candidate out-of-vocabulary word also can be analyzed by secondary classifiers (foreign language trained classifiers) operating in parallel. If the detected out-of-vocabulary word is likely to be mispronounced by the primary language text-to-speech synthesizer according to a prediction by the primary classifier, the system checks if the candidate word corresponds to a word in the lexicon of a secondary language. If so, the system performs a text-to-speech conversion of the candidate out-of-vocabulary word in the appropriate secondary language.

Embodiments herein can include modifying the audio output symbol representation produced for the candidate word in the secondary language to a corresponding in a way the foreign word (i.e., the out-of-vocabulary in the primary language) would be pronounced in the secondary language by a person that speaks the primary language. The modified audio output symbol representation of the foreign candidate word is then used as a representative audio output symbol representation or rendition for the out-of-vocabulary during text-to-speech synthesis. Thus, for instances in which a detected out-of-vocabulary word is a word spoken in a foreign language, it is possible to produce appropriate audio output symbol representation for the out-of-vocabulary word instead of producing improper audio output symbol representation using a grapheme-to-phoneme rules in the primary language.

Accordingly, embodiments herein can include: receiving a text sample to be converted into audio; via a base language classification model, detecting occurrence of an out-of-vocabulary word in the text sample that is likely to be mispronounced via text-to-speech synthesis in a base language; via a foreign language text-to-speech synthesizer, detecting that the out-of-vocabulary word in the text sample is likely to be correctly pronounced via text-to-speech synthesis in a foreign language; and producing the audio output symbol representation to include a spoken representation of the out-of-vocabulary word in the foreign language.

Further embodiments herein include: detecting occurrence of an out-of-vocabulary word in a text sample; detecting a likelihood that the out-of-vocabulary word will be mispronounced using a primary text-to-speech synthesizer; receiving feedback from a source other than the primary text-to-speech synthesizer, the feedback indicating a conversion of the out-of-vocabulary word into a corresponding audio representation; and storing the feedback in a repository.

The occurrence of the out-of-vocabulary word can be is a first occurrence. Embodiments herein can further include detecting a second occurrence of the out-of-vocabulary in a subsequent text sample; accessing the feedback in the repository; and via the accessed feedback, converting the second occurrence of the out-of-vocabulary word to the corresponding audio representation.

In one embodiment, the primary text-to-speech synthesizer converts the text sample in accordance with a primary language. The feedback indicates conversion of the out-of-vocabulary word into a corresponding audio representation in accordance with a foreign language with respect to the primary language.

Embodiments herein also include receiving the feedback from a human reviewer that provides the conversion of the out-of-vocabulary word into the corresponding audio representation.

A distribution resource can be configured to initiate distribution of the feedback in the repository over a network to each of multiple remotely located text-to-speech synthesizer systems. Each of the remotely located text-to-speech synthesizers configured to convert respective text samples for respective clients that access the remotely located text-to-speech synthesizers.

Techniques herein are well suited for use in software and/or hardware applications implementing text-to-speech analysis and synthesis. However, it should be noted that embodiments herein are not limited to use in such applications and that the techniques discussed herein are well suited for other applications as well. These and other embodiments are discussed in more detail below.

Embodiment #2

Use of conventional techniques to convert text-to-speech suffer from further deficiencies. For example, languages evolve over time to include new non-standard text expressions such as non-standard words. The new non-standard text expressions need to be normalized in a quick and efficient manner so that respective text-to-speech synthesizers are able to produce appropriate audio output symbol representation output.

Embodiments herein include novel ways to improve management and text normalization of non-standard words. For example, in accordance with one embodiment, a text analyzer resource receives a sequence of text. Via text analysis, the text analyzer resource identifies a new non-standard word. A text analyzer resource tags the non-standard word in the sequence for further analysis. For example, the text analyzer resource tags the non-standard word to indicate that the identified non-standard word may or may not properly map into a corresponding audio signal.

Embodiments herein can further include identifying instances of new non-standard word type of expressions (such as a number followed by a letter, any type of symbol, etc.) in sample text that a text-to-speech synthesizer would not be able to readily produce an in-context meaning of a particular non-word expression found in sample text. For a newly detected non-standard word in a collection of words that the text-to-speech synthesizer does not know how to expand into corresponding audio, the system initially tags the unfamiliar expression (e.g., non-standard word, sentence including the non-standard word, etc.) with a general tag. Multiple analyzers fine-tune the general tag to more accurately specify the portion of the text that includes the new non-standard word.

By way of a non-limiting example, the reviewers can be human reviewers.

Embodiments herein can include recording how each of the different analyzers think the detected non-standard word should be expanded into corresponding words during subsequent text-to-speech synthesis. Proposed text-to-speech expansion rules for the new non-standard word can be analyzed to determine a degree of agreement amongst the reviewers. The reviewers may agree or disagree as to how to expand a non-standard word. The reviewers may agree or disagree as to an audio output that should be assigned to pronounce the non-standard word.

Additional analysis can be performed in order to determine whether a proposed expansion rule for a corresponding non-standard word is correct. For example, a collection process can be configured to perform additional searches for further instances of the non-standard word in additional text. The system as discussed herein presents the instances to reviewers who determine a degree to which the audio expansion rule for the detected instances is correct.

An expansion rule can be published if there is a high degree of agreement how to expand the newly detected non-standard word.

As discussed above, the analysis process can be repeated for multiple instances of a detected non-standard word until convergence on a common text-to-speech expansion rule for the non-standard word. In other words, when there is convergence with respect to how an non-standard word text expression should be expanded during text-to-speech synthesis, it may become clear based on feedback from multiple analyzers (e.g., human or machine analyzers) how to expand the non-standard word during subsequent text-to-speech synthesis.

If there is agreement on how to expand the newly detected non-standard word, the system creates (or releases for distribution) a tested expansion rule for the non-standard word. In one embodiment, the expansion rule can indicate how to expand the non-standard word in a number of different ways depending on a context in which the non-standard word is used.

Upon detecting a new non-standard word and creation of an appropriate expansion rule for the non-standard word, one or more text-to-speech synthesizers (e.g., in-the-cloud text-to-speech synthesizers used by subscribers, privately owned and operated text-to-speech synthesizers, etc.) can be updated to include the expansion pattern/rule and how an instance of the pattern in newly received text should be expanded depending on context. As an example, the pattern/rule to expand the non-standard word KM may always expand into the audible phrase "kilometers" regardless of context.

As discussed herein, the expansion rule for an instance of the non-standard word "M" in a sample text can indicate different ways to expand a non-standard word depending on a parameter such as context. For example, the term "7M" may mean "seven million" in the financial context; the term "7M" may refer to "seven meters" in a sports context. Thus, if there is no convergence on a single type of expansion, the expansion rule can be designed to expand differently based on different usage. Thus, embodiments herein also can include expanding a non-standard word in a different manner depending on context.

Techniques herein are well suited for use in software and/or hardware applications implementing text-to-speech synthesis. However, it should be noted that embodiments herein are not limited to use in such applications and that the techniques discussed herein are well suited for other applications as well. These and other embodiments are discussed in more detail below.

As mentioned above, note that embodiments herein can include a configuration of one or more computerized devices, workstations, handheld or laptop computers, or the like to carry out and/or support any or all of the method operations disclosed herein. In other words, one or more computerized devices or processors can be programmed and/or configured to operate as explained herein to carry out different embodiments of the invention.

Yet other embodiments herein include software programs to perform the steps and operations summarized above and disclosed in detail below. One such embodiment comprises a computer program product including a non-transitory computer-readable storage medium (i.e., any type of hardware storage medium) on which software instructions are encoded for subsequent execution. The instructions and/or program, when executed in a computerized device having a processor, cause the processor to perform the operations disclosed herein. Such arrangements are typically provided as software, code, instructions, and/or other data (e.g., data structures) arranged or encoded on a non-transitory computer readable storage medium such as an optical medium (e.g., CD-ROM), floppy disk, hard disk, memory stick, etc., or other a medium such as firmware or microcode in one or more ROM, RAM, PROM, etc., or as an Application Specific Integrated Circuit (ASIC), etc. The software or firmware or other such configurations can be installed onto a computerized device to cause the computerized device to perform the techniques explained herein.

Accordingly, one particular embodiment of the present disclosure is directed to a computer program product that includes a computer readable storage medium having instructions stored thereon to facilitate conversion of text-to-speech. For example, in one embodiment, the instructions, when executed by a processor of a respective computer device, cause the processor to: implement a lexicon lookup algorithm in first text-to-speech hardware to produce an audio output for each word in a set of multiple words; implement a grapheme-to-phoneme algorithm in second text-to-speech hardware to produce an audio output for each word in the set of multiple words; for each word in the set: perform a comparison of an audio output of the first text-to-speech hardware and an audio output of the second text-to-speech hardware; and classify each of the multiple words depending on the comparison.

Another embodiment of the present disclosure is directed to a computer program product that includes a computer readable storage medium having instructions stored thereon to facilitate conversion of text-to-speech. For example, in one embodiment, the instructions, when executed by a processor of a respective computer device, cause the processor to: detect occurrence of an out-of-vocabulary word in a text sample to be converted into audio output; estimate a probability that the out-of-vocabulary word will be mispronounced using a text-to-speech synthesizer; and select amongst multiple sources from which to produce an audio rendition of the out-of-vocabulary word depending on a magnitude of the probability.

Another embodiment of the present disclosure is directed to a computer program product that includes a computer readable storage medium having instructions stored thereon to facilitate conversion of text-to-speech. For example, in one embodiment, the instructions, when executed by a processor of a respective computer device, cause the processor to: receive a sequence of text; identify a non-standard word in the sequence of text; and tag the non-standard word in the sequence for analysis, the tagging indicating that the identified non-word expression does not readily map to a corresponding text-to-speech audio signal.

The ordering of the steps has been added for clarity sake. These steps can be performed in any suitable order.

Other embodiments of the present disclosure include software programs and/or respective hardware to perform any of the method embodiment steps and operations summarized above and disclosed in detail below.

It is to be understood that the system, method, apparatus, instructions on computer readable storage media, etc., as discussed herein can be embodied strictly as a software program, as a hybrid of software and hardware, or as hardware alone such as within a processor, or within an operating system or a within a software application. Example embodiments of the invention may be implemented within products and/or software applications such as those manufactured by Nuance Communications, Inc., Burlington, Mass., USA.

Additionally, although each of the different features, techniques, configurations, etc., herein may be discussed in different places of this disclosure, it is intended that each of the concepts can be executed independently of each other or, where suitable, the concepts can be used in combination with each other. Accordingly, the one or more present inventions as described herein can be embodied and viewed in many different ways.

Also, note that this preliminary discussion of embodiments herein does not specify every embodiment and/or incrementally novel aspect of the present disclosure or claimed invention(s). Instead, this brief description only presents general embodiments and corresponding points of novelty over conventional techniques. For additional details and/or possible perspectives (permutations) of the invention(s), and additional points of novelty, the reader is directed to the Detailed Description section and corresponding figures of the present disclosure as further discussed below.

BRIEF DESCRIPTION OF THE DRAWINGS

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, etc.

FIG. 3 is an example diagram illustrating detection of an out-of-vocabulary word and generation of an audio output according to embodiments herein.

FIG. 4 is an example diagram illustrating detection of an out-of-vocabulary word and generation of an audio output according to embodiments herein.

DETAILED DESCRIPTION

Embodiments herein can be used to solve the problem of mispronunciations originating from the text analysis component of text-to-speech systems. In particular, embodiments herein address mispronunciations of out-of-vocabulary words. Thus far, conventional systems have only been possible to detect mispronunciations using costly and limited listening tests. Due to the nature of the problem, in particular the way the mispronounced words tend to appear/disappear in a language, the conventional approach is undesirable.

Figure 1:
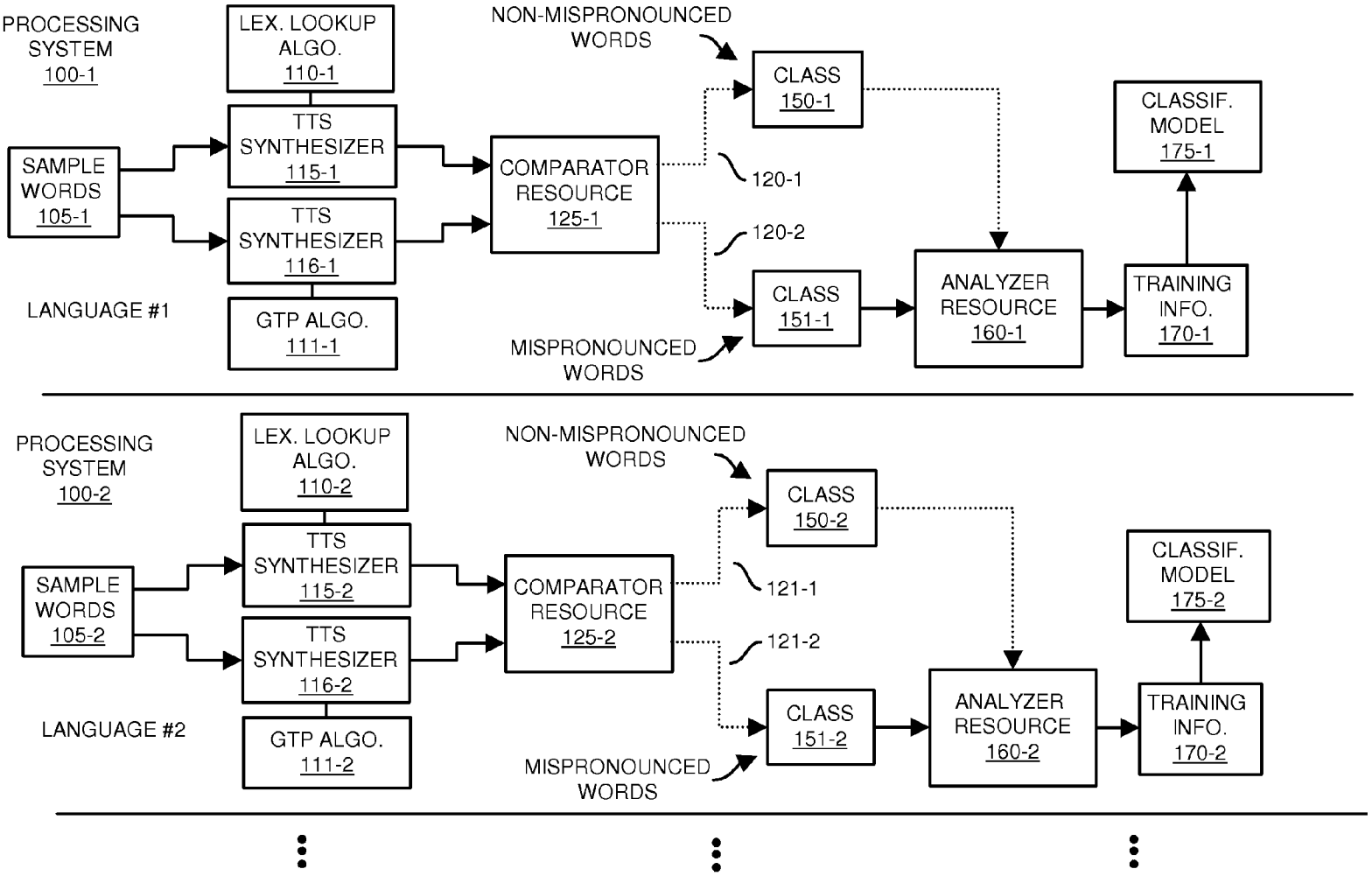
FIG. 1 is an example diagram of a processing system according to embodiments herein.

FIG. 1 is an example diagram of a speech-processing system according to embodiments herein.

As shown, in accordance with one embodiment, a text-to-speech analyzer resource can include multiple text-to-speech synthesizers operating in parallel. For example, processing system 100-1 includes text-to-speech synthesizer 115-1 and text-to-speech synthesizer 116-1. Each text-to-speech synthesizer produces audio output symbol representation (e.g., signal, one or more symbols, etc.) for each word in the set or sample words 105-1.

By way of a non-limiting example, each text-to-speech synthesizer can be part of a front-end text-to-speech processing system that produces a set of symbols. A back end processing system can be configured to use the symbols to produce an appropriate audio output signal.

By way of a non-limiting example, the set or sample words 105-1 can include a full lexicon indicating how to perform text-to-speech synthesis of words, sub-words, etc., in a particular language. A lexicon can include words, morphemes, etc.

In one embodiment, text-to-speech synthesizer 115-1 executes a lexicon lookup algorithm to produce an audio output symbol representation 120-1 for each word in set of sample words 105-1. During operation, text-to-speech synthesizer 115-1 executes lexicon lookup algorithm 110-1 to perform text-to-speech synthesis of words, subscriber-words, etc., in a lexicon of a first language. Via the lookup, the lexicon lookup algorithm 110-1 identifies a corresponding audio output symbol representation 120-1 to produce for a respective word. The audio output symbol representation 120-1 for each word is considered to be substantially accurate because the lexicon lookup algorithm relies on a verified text to audio mappings.

The text-to-speech synthesizer 115-2 simultaneously implements a grapheme-to-phoneme algorithm or other suitable best efforts algorithm in to produce an audio output symbol representation for each word in the set or sample words 105-1. The text-to-speech synthesizer 116-1 produces the audio output symbol representation 121-2 for each word as if the word was an out-of-vocabulary word. By way of a non-limiting example, an out-of-vocabulary word is a word that does not readily map into a known and/or verified audio output symbol representation.

For a given sample word from set or sample words 105-1, the text-to-speech synthesizer 116-1 produces audio output symbol representation 121-1. In certain instances, the grapheme-to-phoneme algorithm or other suitable algorithm executed by the text-to-speech synthesizer 116-1 may produce an incorrect audio output symbol representation of a word or portion of a word because the grapheme-to-phoneme algorithm 111-1 is only a best efforts type algorithm.

In one embodiment, the text-to-speech synthesizers 115-1 and 116-1 produce a transcription for each of all words, sub-words, etc., found in a standard system's full form lexicon.

For each respective word in the set or sample words 105-1, the comparator resource 125-1 (e.g., a text-to-speech analyzer resource) performs a comparison of a respective audio output symbol representation 120-1 and a respective audio output symbol representation 120-2.

Note that audio output symbol representations 120-1, 120-2, 121-1, 121-2, etc., can be produced in any suitable format. For example, the audio output symbol representations can be digital information, an analog signal, etc. In general, the audio output symbol representation is a rendition or representation of the corresponding text when audibly produced by a respective text-to-speech synthesizer.

Embodiments herein include performing a smart comparison of generated transcriptions (ignoring allophonic differences, etc.). In one embodiment, as mentioned, the transcriptions are divided into two groups depending on whether or not they are different for the two text-to-speech synthesizer systems. More specifically, the comparator resource 125-1 classifies each of the multiple sample words 105-1 (such as a full lexicon of language #1) depending on the comparison.

For example, if the audio output symbol representation 120-1 produced by the text-to-speech synthesizer 115-1 is substantially the same as an audio output symbol representation 120-2 produced by the text-to-speech synthesizer 116-1 for a respective word, then the respective word is placed in class 150-1. For words in class 150-1, the grapheme-to-phoneme algorithm produces the substantially same audio output symbol representation as the lexicon lookup algorithm.

Additionally, if the audio output symbol representation 120-1 produced by the text-to-speech synthesizer 115-1 is substantially different than an audio output symbol representation 120-2 produced by the text-to-speech synthesizer 116-1 for a respective word, then the respective word is placed in class 151-1. For words in class 151-1, the grapheme-to-phoneme algorithm executed by text-to-speech synthesizer 116-1 is unable to produce an accurate audio rendition for the respective word.

Thus, in one non-limiting embodiment, the text-to-speech analyzer resource as discussed herein keeps track of which of the multiple words are pronounced the same and which words are pronounced differently as produced by the lexicon lookup algorithm and the grapheme-to-phoneme algorithm.

In accordance with further embodiments, analyzer resource 160-1 analyzes words in class 151-1 such as the instances in which the grapheme-to-phoneme algorithm (such as text-to-speech synthesizer 116-1) produces a different audio output symbol representation than the lexicon lookup algorithm (such as the text-to-speech synthesizer 115-1).

In one embodiment, the analyzer resource 160-1 accesses either class 151-1 and/or both class 150-1 and class 151-1 to produce training information 170-1.

The analyzer resource 160-1 analyzes the subset of words in class 151-1 to identify instances in which the grapheme-to-phoneme algorithm produces an improper audio rendition output for words, sub-words, etc., in class 151-1. Based on the analysis and instances where the errors occur in text-to-speech synthesis, the analyzer resource 160-1 produces training information 170-1. Training information 170-1 can include a set of predictor rules indicating a likelihood of whether the grapheme-to-phoneme algorithm can be used to convert received patterns of text into appropriate speech.

In one embodiment, the analyzer resource produces a set of predictors (orthographic/phonetic n-gram statistics, number of syllables, etc.) for training a classifier or classification model, whose task is to predict which types of previously detected orthographic entries lead to differences in transcriptions by the two text-to-speech synthesizers 115-1 and 116-1.

Using the set of predictors and the information about differences of the transcriptions generated by the two systems as captured by the training information 170-1, classification model 175-1 is trained. For example, in one embodiment, the processing system 100-1 utilizes the training information 170-1 to train classification model 175-1. As discussed further in this specification, the classification model 175-1 can be used to detect which out-of-vocabulary words in received text are likely to be mispronounced by respective text-to-speech synthesizer using grapheme-to-phoneme text-to-speech synthesis.

As shown, a classification model can be trained for each of multiple different languages. For example, text-to-speech synthesizer 115-2 and text-to-speech synthesizer 116-2 receive text-based words 105-2 in a second language (e.g., Spanish). For each Spanish word in set or sample words 105-2, the text-to-speech synthesizer 115-2 generates the audio output symbol representation 121-1 using a lexicon lookup algorithm 110-2 for the second language; the text-to-speech synthesizer 116-2 generates the audio output symbol representation 121-2 using a grapheme-to-phoneme lexicon lookup algorithm 111-2 for the second language. In a similar manner as discussed above for language #1, comparator resource 125-2 classifies the words 105-2 in class 150-1 and class 151-2 for language #2. Analyzer resource 160-2 analyzes the words in class 151-2 and produces training information 170-2. Training information 170-2 is used to produce classification model 175-2 for the second language.

Figure 2:
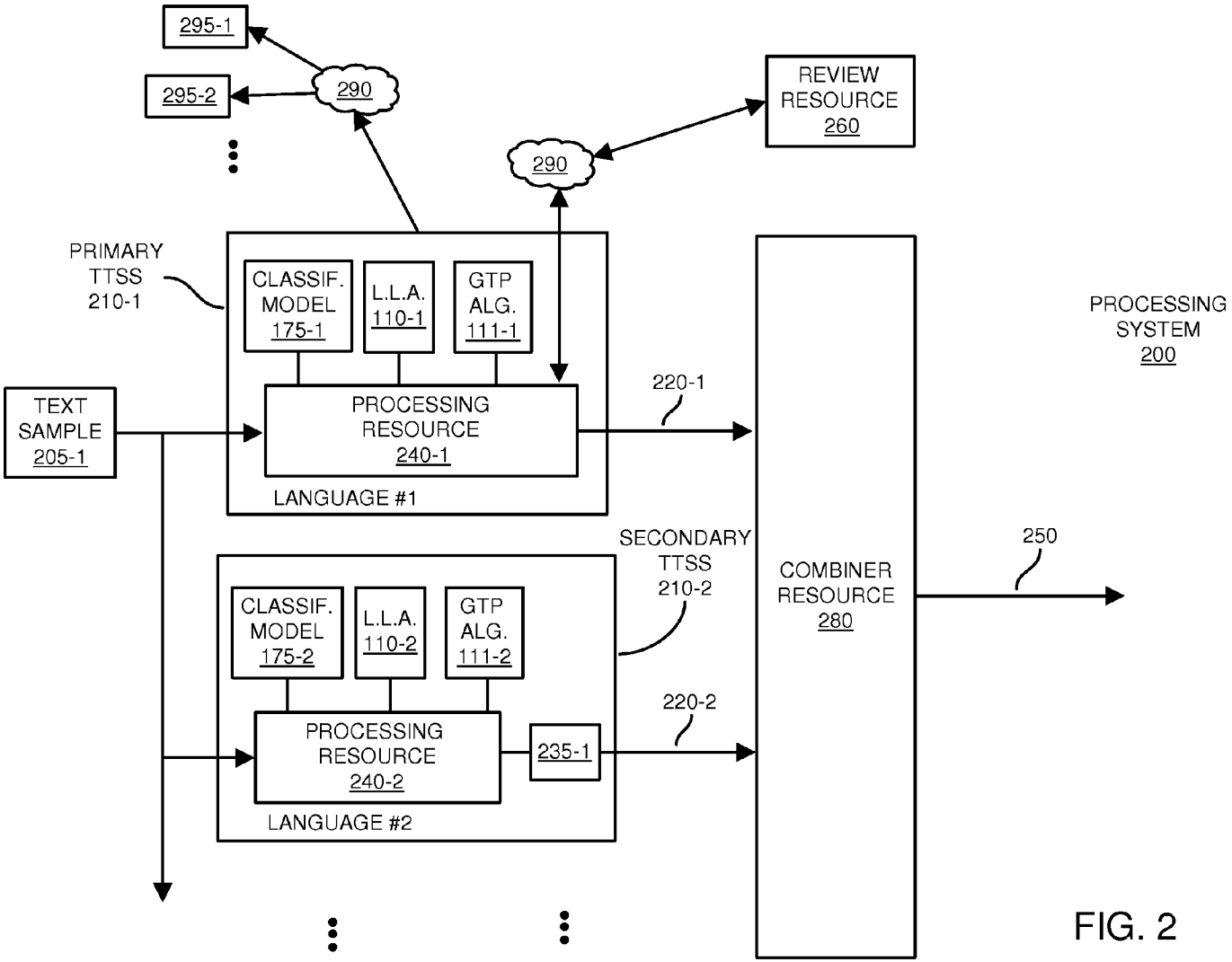
FIG. 2 is an example diagram illustrating a synthesizer system according to embodiments herein.

The above processing allows for training the classification models on large sets of data without the need to obtain manual references manually (e.g. via costly listening tests). As a result, as discussed herein, mispronunciation estimation and/or producing the classification models for each language can be fully automated. FIG. 2 is an example diagram illustrating a text-to-speech synthesizer according to embodiments herein.

Embodiments herein can include implementing mispronunciation detection and estimation techniques to produce a respective audio output 250 with relatively few, if any, errors.

As an example, the primary text-to-speech synthesizer 210-1 receives text sample 205-1 (e.g., multiple different words of to be converted into corresponding audio output symbol representation). The text sample 205-1 to be converted into audio output symbol representation 250 can be received from any number of different sources (e.g., a web server, an e-mail, a word document, etc.). In one embodiment, a user accesses processing 200 and provides or specifies the text to be converted into audio.

The processing resource 240-1 first analyzes the text sample 205-1 for occurrence of out-of-vocabulary words. The processing resource 240-1 can detect out-of-vocabulary words by applying morpho-syntactic or other suitable analysis to the received text sample 205-1. The morpho-syntactic analysis can be supplemented by a full form lexicon look up, or by means of statistical analysis in case of systems without a lexicon.

In more specific embodiments, for words in text sample 205-1 that are not detected as being out-of-vocabulary words, the primary text-to-speech synthesizer 210-1 uses any suitable algorithm such as a lexicon lookup algorithm to produce corresponding audio output symbol representation for such words. In one embodiment, the first attempts to perform text-to-speech synthesis using lexicon lookup algorithm 110-1. If a lookup fails, the candidate word is considered an out-of-vocabulary word.

Thus, for a portion of the words (i.e., out-of-vocabulary words) in the text sample 205-1 that do not map to a corresponding audio output symbol representation (e.g., the primary text-to-speech synthesizer 210-1 cannot use a respective lexicon lookup algorithm 110-1 or other suitable algorithm to generate audio output symbol representation for a respective word in text sample 205-1), the primary text-to-speech synthesizer 210-1 resource classifies the words as out-of-vocabulary words.

For these words, the processing resource 240-1 uses the trained classification model 175-1 to estimate which out-of-vocabulary words are likely to be mispronounced if text-to-speech synthesis was performed using grapheme-to-phoneme algorithm 111-1. For example, the primary text-to-speech synthesizer 210-1 can be configured to use the classification model 175-1 to estimate a probability that a respective detected out-of-vocabulary word will be mispronounced using the a locally available source such as grapheme-to-phoneme algorithm 111-1 during text-to-speech synthesis.

Depending on a magnitude of the probability that an out-of-vocabulary word will be mispronounced using a locally available grapheme-to-phoneme algorithm 111-1, the primary text-to-speech synthesizer 210-1 can be configured to produce the audio output symbol representation 250 to include an audio output symbol representation or rendition of the out-of-vocabulary word from any of one or more sources.

For example, if the classification model 175-1 indicates that there is a low probability such as below a threshold value that a grapheme-to-phoneme algorithm 111-1 or other suitable algorithm readily available to the primary text-to-speech synthesizer 210-1 will mispronounce a respective out-of-vocabulary word, then the primary text-to-speech synthesizer 210-1 can use such an readily available algorithm to generate the audio output symbol representation for the out-of-vocabulary word.

On the other hand, the classification model 175-1 can indicate that there is a high probability that a readily available source such as grapheme-to-phoneme rules 111-1 will mispronounce a respective out-of-vocabulary word. In one embodiment, in such an instance, a source other than a primary (language) text-to-speech synthesizer 210-1 can be selected to generate an audio output symbol representation of the out-of-vocabulary word.

For example, if appropriate resources are available, multiple text-to-speech synthesizers (e.g., primary text-to-speech synthesizer 210-1, secondary text-to-speech synthesizer 210-2, etc.) can be simultaneously operated in parallel. Each of these text-to-speech synthesizers can handle text-to-speech conversion in a different language. For example, the primary text-to-speech synthesizer 210-1 can convert words in a first language such as English, secondary text-to-speech synthesizer 210-2 can convert words in a second language such as Spanish, and so on.

In many instances, the out-of-vocabulary words are foreign language words. In other words, text sample may include foreign words not known to the primary text-to-speech synthesizer 210-1. As discussed below in the following figures, operating the different language text-to-speech synthesizers in parallel during text-to-speech synthesis enables proper conversion of foreign language out-of-vocabulary words to be properly converted into audio output symbol representation via a foreign language text-to-speech synthesizer. In this manner, it is possible to produce a more accurate audio output symbol representation 250 based on text sample 205-1.

In one embodiment as mentioned, each of the text-to-speech synthesizers 210 can be configured to simultaneously operate in parallel to convert text in text sample 205-1 into appropriate audio output symbol representations.

In accordance with further embodiments, note that processing the text sample 205-1 in parallel using multiple text-to-speech synthesizers 210 is optional. If desired, while non-primary text-to-speech synthesizers (e.g., text-to-speech synthesizer 210-2, text-to-speech synthesizer 210-3, etc.) are disabled, the primary text-to-speech synthesizer 210-1 can be configured to analyze text sample 205-1 to convert the text sample 205-1 into corresponding audio output symbol representations. Upon detecting text that the primary text-to-speech synthesizer 210-1 is unable to readily translate into a corresponding audio output symbol representations, the primary text-to-speech synthesizer 210-1 can be configured to generate appropriate control signals causing one or more other text-to-speech synthesizers to attempt text-to-speech synthesis of the respective text. Thus, the foreign language text-to-speech synthesizers can be used as a backup to convert a given out-of-vocabulary word if the primary text-to-speech synthesizer 210-1 is unable to convert the out-of-vocabulary word into a corresponding audio output symbol representation with sufficient confidence.

As discussed herein, typically, at least one of the text-to-speech synthesizers 210 may be able to convert the text into a property audio output symbol representation. However, it is possible that none of the text-to-speech synthesizer systems 210 is able to convert respective text in text sample 205-1 (i.e., text in question) into an appropriate audio output symbol representation. In such an instance, the processing system 200 can be configured to communicate the instance of the text in question over network 290 to review resource 260. By way of a non-limiting example, the review resource 260 can provide manual review of the text in question and provide feedback such as a an appropriate audio output symbol representation of the text in question to primary text-to-speech synthesizer 210-1.

Accordingly, the generation of an appropriate audio output symbol representation for given text can be received from a number of different resources. For example, the primary text-to-speech synthesizer 210-1 may be able to produce an appropriate audio output symbol representation for given text in the text sample 205-1. As a backup, and as discussed herein, one or more foreign language text-to-speech synthesizers (e.g., secondary text-to-speech synthesizer 210-2, text-to-speech synthesizer 210-3, etc.) may be able to generate an appropriate audio output symbol representation for certain text in the text sample 205-1. As a further backup, the review resource such as one or more manual human reviewers such as review resource 260 can provide feedback such as audio output symbol representation indicating how to synthesize the respective out-of-vocabulary word.

In accordance with further embodiments, the processing system 200 can be configured to store a library 265 of text or out-of-vocabulary word instances that the primary text-to-speech synthesizer 210-1 is unable to convert into corresponding audio output symbol representations with a high degree of confidence. For example, as previously discussed, one or more other secondary text-to-speech synthesizers (e.g., text-to-speech synthesizer 210-2 can provide the appropriate conversion) or review resource 260 can provide the appropriate text to audio output symbol representation conversion information for a particular out-of-vocabulary word. In one embodiment, the processing system 200 stores the appropriate audio output symbol representation conversions for multiple out-of-vocabulary words with respect to primary text-to-speech synthesizer 210-1.

Via the library 265, the primary text-to-speech synthesizer 210-1 is able to more quickly produce an appropriate conversion to audio output symbol representation. For example, assume that the primary text-to-speech synthesizer 210-1 is initially unable to convert a particular out-of-vocabulary word into an appropriate audio output symbol representation. The processing system 200 can receive feedback from the other text-to-speech synthesizers or manual reviewers of the proper conversion for the particular out-of-vocabulary word. Upon subsequent receipt of the particular word in a text sample, the primary text-to-speech synthesizer 210-1 uses the library 265 as a basis to look up and then convert the particular text into an appropriate audio output symbol representation. Thus, embodiments herein can include learning how to handle out-of-vocabulary words and then using the learned information (i.e., in library 265) to more quickly produce accurate text-to-speech outputs.

In accordance with another embodiment, the processing system 200 is a master text-to-speech synthesizer system that learns of out-of-vocabulary words and how to handle future occurrences of them in respective text samples as discussed above. Embodiments herein can include multiple remotely operating text-to-speech synthesizer systems 295 (e.g., text-to-speech synthesizer 295-1, text-to-speech synthesizer 295-2, . . . ) that rely on the master text-to-speech synthesizer system to produce audio output symbol representations for new out-of-vocabulary words. In such an instance, the distribution resource 292 of processing system 200 can be configured to disseminate the library 265 of out-of-vocabulary words and corresponding audio output symbol representations to one or more text-to-speech synthesizers 295.

Each of the text-to-speech synthesizers 295 can receive their own sets of text samples and convert such samples into respective audio output symbol representations using only a respective lexicon lookup algorithm. In other words, the remote text-to-speech synthesizers 295 may not include appropriate processing resources to carry out processing as does primary text-to-speech synthesizer 210-1, secondary text-to-speech synthesizer 210-2, . . . . The remote text-to-speech synthesizers 295 also may not have access to review resource 260.

Distribution of the library 265 enables the text-to-speech synthesizers 295 (and other clients who use the remote text-to-speech synthesizers 295) to benefit from learnings of the master text-to-speech synthesizer and perform more accurate text-to-speech synthesis. For example, a remote text-to-speech synthesizer 295 may receive (from a client serviced by the text-to-speech synthesizer 295) an instance of the particular out-of-vocabulary word to convert. The lexicon lookup algorithm executed by the remote text-to-speech synthesizer 295 may not be able to convert the particular out-of-vocabulary into a corresponding audio output symbol representation. Via the library 265, the text-to-speech synthesizer 295 is able to convert the particular out-of-vocabulary word into an appropriate audio output symbol representation.

FIG. 3 is an example diagram illustrating detection of an out-of-vocabulary word and generation of an audio output according to embodiments herein.

As previously discussed, in one embodiment, the processing system 200 includes multiple text-to-speech synthesizers that execute in parallel. Each text-to-speech synthesizer first attempts to produce an audio output symbol representation or rendition of a word in text sample 205-1 using a respective lexicon lookup algorithm.

In this example embodiment, the text sample 205-1 to be synthesized is the phrase "The Spanish word cocina means kitchen in English." As shown in FIG. 3, the primary text-to-speech synthesizer 210-1 is able to find an appropriate entry using the lexicon lookup algorithm 110-1 to produce a rendition of the word "the" in the first language. In such an instance, the processing resource 240-1 outputs the audio output symbol representation or rendition for the respective word "the" as output 220-1 to combiner resource 280. The secondary text-to-speech synthesizer 210-2 may not produce an output for the word "the" because it is not found in the Spanish (i.e., language #2) lexicon using lexicon lookup algorithm 110-2.

The parallel synthesizers then process the next word "Spanish" in the text sample 205-1. As shown, the primary text-to-speech synthesizer 210-1 is able to find an appropriate entry in the lexicon lookup algorithm 110-1 to produce a rendition of the word "Spanish." In such an instance, the processing resource 240-1 outputs the audio output symbol representation or rendition for the respective word "Spanish" as output 220-1 to combiner resource 280. The secondary text-to-speech synthesizer 210-2 may not produce an output for the word "Spanish" because it is not found in the Spanish (i.e., language #2) lexicon using lexicon lookup algorithm 110-2.

The parallel synthesizers then process the next word "word" in the text sample 205-1. As shown, the primary text-to-speech synthesizer 210-1 is able to find an appropriate entry in the lexicon lookup algorithm 110-1 to produce a rendition of the word "word." In such an instance, the processing resource 240-1 outputs the audio output symbol representation or rendition for the respective word "word" as output 220-1 to combiner resource 280. The secondary text-to-speech synthesizer 210-2 may not produce an output for the word "word" because it is not found in the Spanish (i.e., language #2) lexicon using lexicon lookup algorithm 110-2.

The parallel synthesizers then process the next word "cocina" in the text sample 205-1. As shown, the primary text-to-speech synthesizer 210-1 is not able to find an appropriate entry in the lexicon lookup algorithm 110-1 to produce a rendition of the word "cocina" because it is a Spanish word. In one embodiment, the processing resource 240-1 uses classification model 175-1 to determine whether the grapheme-to-phoneme algorithm 111-1 (or other suitable best efforts algorithm) will be able to accurately pronounce the word "cocina."

Assume in this example that the classification model 175-1 indicates a high probability of mispronouncing the word "cocina" based on training information 170-1. Assume further in this example that the secondary text-to-speech synthesizer 210-2 is able to perform a lexicon lookup algorithm of the word "cocina" to produce an appropriate audio output symbol representation for the word in the secondary language (e.g., Spanish language). In such an instance, the processing resource 240-2 of secondary text-to-speech synthesizer 210-2 produces an audio output symbol representation or rendition for the respective word "cocina" in the Spanish language.

In one embodiment, the processing resource 240-2 produces the synthesized audio output symbol representation for the word "cocina" as though the word "cocina" was spoken by a native, Spanish-speaking person.

In one embodiment, for playback continuity, the secondary text-to-speech synthesizer 210-2 can include audio modifier algorithm 235-1. The audio modifier algorithm 235-1 can be configured to modify the audio output symbol representation or rendition produced by the processing resource 240-2 such that the output 220-1 produced for the word "cocina" sounds as though the Spanish version of word "cocina" was spoken by an English speaking person.

The primary text-to-speech synthesizer 210-1 repeats this process for each subsequent word in text sample 205-1.

In one embodiment, combiner resource 280 interleaves the outputs from each of the different text-to-speech synthesizers to produce audio output symbol representation 250 as they are received. By way of a non-limiting example, for instances in which the primary text-to-speech synthesizer 210-1 is able to perform a lookup to identify proper audio output symbol representation for words in the text sample 205-1, the combiner resource 280 uses the output produced by primary text-to-speech synthesizer 210-1 for such words. For words (e.g., cocina) that do not provide a match lookup in the primary language, the combiner resource selects from a foreign language text-to-speech synthesizer (i.e., secondary text-to-speech synthesizer 210-2) to produce audio output symbol representation 250.

Thus, in this example, the combiner resource 280 interleaves audio output symbol representations from primary text-to-speech synthesizer 210-1 and secondary text-to-speech synthesizer 210-2 to produce audio output symbol representation 250. That is, the combiner resource 280 uses audio output symbol representation output 220-1 from primary text-to-speech synthesizer 210-1 to produce the audio output symbol representation 250 for the word "the" in text sample 205-1, the combiner resource 280 uses audio output symbol representation output 220-1 from primary text-to-speech synthesizer 210-1 to produce the audio output symbol representation 250 for the next word "Spanish" in text sample 205-1, the combiner resource 280 uses audio output symbol representation 220-1 from primary text-to-speech synthesizer 210-1 to produce the audio output symbol representation output 250 for the next word "word" in text sample 205-1, the combiner resource 280 uses audio output symbol representation 220-2 from secondary text-to-speech synthesizer 210-2 to produce the audio output symbol representation 250 for the next word "cocina" in text sample 205-1, the combiner resource 280 uses audio output symbol representation 220-1 from primary text-to-speech synthesizer 210-1 to produce the audio output symbol representation 250 for the next word "means" in text sample 205-1, the combiner resource 280 uses audio output symbol representation 220-1 from primary text-to-speech synthesizer 210-1 to produce the audio output symbol representation 250 for the next word "kitchen" in text sample 205-1, the combiner resource 280 uses audio output symbol representation 220-1 from primary text-to-speech synthesizer 210-1 to produce the audio output symbol representation 250 for the next word "in" in text sample 205-1, the combiner resource 280 uses audio output symbol representation output 220-1 from primary text-to-speech synthesizer 210-1 to produce the audio output symbol representation 250 for the next word "English" in text sample 205-1. Thus, via the parallel text-to-speech synthesizers, the processing system 200 produces an accurate audio output symbol representation "The Spanish word cocina means kitchen in English" for text sample 205-1.

In contrast to embodiments herein, conventional text-to-speech synthesizers would likely apply a best efforts algorithm and mispronounce the foreign language word "cocina".

FIG. 4 is an example diagram illustrating detection of an out-of-vocabulary word and generation of an audio output symbol representation according to embodiments herein.

As previously discussed, in one embodiment, the processing system 200 includes multiple text-to-speech synthesizers that execute in parallel. Each text-to-speech synthesizer attempts to produce a proper audio rendition of a word in text sample 205-1 using a respective lexicon lookup algorithm.

In this example embodiment, the text sample 205-1 to be synthesized is the phrase "We are taking a greycation in Disney." The word "greycation" is a slang term meaning a vacation including grandparents. Assume that the word "greycation" in text sample 205-1 is detected as being an out-of-vocabulary word in this example.

As previously discussed, the primary text-to-speech synthesizer 210-1 and one or more secondary text-to-speech synthesizer 210-2 process the words in text sample 205-1. In this example, the primary text-to-speech synthesizer 210-1 is able to find an appropriate entry in the lexicon lookup algorithm 110-1 to produce a rendition of the word "We". In such an instance, the processing resource 240-1 outputs the audio output symbol representation or rendition for the respective word "we" as output 220-1 to combiner resource 280.

The parallel synthesizers then process the next word "taking" in the text sample 205-1. As shown, the primary text-to-speech synthesizer 210-1 is able to find an appropriate entry in the lexicon lookup algorithm 110-1 to produce a rendition of the word "taking." In such an instance, the processing resource 240-1 outputs the audio output symbol representation or rendition for the respective word "taking" as output 220-1 to combiner resource 280.

The parallel synthesizers then process the next word "a" in the text sample 205-1. As shown, the primary text-to-speech synthesizer 210-1 is able to find an appropriate entry in the lexicon lookup algorithm 110-1 to produce a rendition of the word "a." In such an instance, the processing resource 240-1 outputs the audio output symbol representation or rendition for the respective word "a" as output 220-1 to combiner resource 280. Note that even if the word "a" is found by a lexicon lookup algorithm in a foreign language text-to-speech synthesizer (e.g., secondary text-to-speech synthesizer 210-2), the output of the primary text-to-speech synthesizer 210-1 is given priority for playback as it is the primary language in which the text sample 205-1 is being synthesized.

The parallel synthesizers eventually process word "greycation" in the text sample 205-1. As shown, by way of a non-limiting example, the primary text-to-speech synthesizer 210-1 flags the word as being an out-of-vocabulary word because it is not able to find an appropriate entry in the lexicon lookup algorithm 110-1 to produce a rendition of the word "greycation."

The processing resource 240-1 uses classification model 175-1 to determine whether the grapheme-to-phoneme algorithm 111-1 (or other suitable best efforts algorithm) will be able to accurately pronounce the word "greycation." In this example, assume that the classification model 175-1 indicates a low probability below a threshold value that the grapheme-to-phoneme algorithm 111-1 will mispronounce the word "greycation" based on training information 170-1.

Assume further in this example that the secondary text-to-speech synthesizer 210-2 or other foreign language text-to-speech synthesizers are able to perform a lexicon lookup algorithm of the word "greycation" to produce an appropriate audio output symbol representation for the word in the secondary languages. In such an instance, because there is a low probability of mispronunciation via local source grapheme-to-phoneme algorithm 111-1, the processing resource 240-1 of primary text-to-speech synthesizer 210-1 produces an audio output symbol representation or rendition for the respective word "greycation" in the English language.

The primary text-to-speech synthesizer 210-1 repeats this process for each subsequent word in text sample 205-1.

The combiner resource 280 strings the output 220-1 produced by primary text-to-speech synthesizer 210-1 for each word to produce audio output symbol representation 250, which is an accurate audio output symbol representation or rendition "We are taking a greycation in Disney" for text sample 205-1.

Thus, in certain instances, even foreign language text-to-speech synthesizers may not be able to produce an audio output symbol representation signal for an out-of-vocabulary word. In such an instance, the local grapheme-to-phoneme algorithm in the primary language can be used to produce the appropriate audio output symbol representation with reasonable accuracy.

Summarizing the above embodiments, if a given word is known or estimated as correctly being transcribed by a system of a foreign or secondary language, simple phoneme mapping can be applied to extend the lexicon of the primary language to lexicons of foreign languages. If the word is known, other related information (e.g. part-of-speech, language tag, etc.) can be transferred to the target lexicon of the primary language.

As mentioned, embodiments herein can include classifying and prioritizing the potentially mispronounced words (i.e., the out-of-vocabulary words). Classification can include categories such as Proper Names, Typos, Other, etc.

Human judges or semi-automated procedures can be used to classify the detected out-of-vocabulary words.

Prioritization can includes an analysis of the behaviour of the given word with respect to its occurrence. Prioritization can include two categories: so-called Pop-ups and Evergreens.

Pop-ups represent out-of-vocabulary words that appear and disappear within a short interval. For instance, more than 80% of mispronounced words typically disappear from English written news articles within 1 week as they are replaced by new mispronounced words.

Evergreens represent words that keep appearing in different documents, newsfeeds, etc. Approximately 2-3% of the mispronounced words in the Evergreen class keep appearing for more than 1 month in the English news articles.

As mentioned, if transcription (i.e., text-to-speech synthesis) cannot be performed via a lexicon lookup algorithm in the primary text-to-speech synthesizer 210-1, and none of the other secondary text-to-speech synthesizers is able to perform a lexicon lookup, then the primary text-to-speech synthesizer 210-1 can be configured to generate, via best or reasonable efforts, an audio rendition of the out-of-vocabulary word using the grapheme-to-phoneme algorithm 111-1.

In one embodiment, the processing resource 240-1 or primary text-to-speech synthesizer 210-1 communicates the generated transcription for out-of-vocabulary words over network 290 (such as the Internet, local area network, etc.) to review resource 260. Review resource 260 can include human judges and/or reviewers that determine whether the best efforts text-to-speech synthesis of a respective out-of-vocabulary word is correctly pronounced or not. In other words, the reviewer resource 260 can make a determination whether the audio output symbol representation produced by the grapheme-to-phoneme 111-1 is correct or not. The audio output symbol representation may be incorrect even though a respective classification model indicates a low probability of failure.

Note that different possible pronunciation alternatives can be obtained by applying one or more of the grapheme-to-phoneme algorithms (e.g., in the primary and/or secondary languages). In such an instance, the reviewer resource 260 (e.g., one or more machine or human reviewers) can review the proposed audio output symbol representations for a respective candidate out-of-vocabulary word.

The reviewer resource 260 such as one or more human or machine judges can either select one of the proposed alternatives as a proper audio output symbol representation or present a new transcription for the candidate out-of-vocabulary word. The reviewer resource 260 can also pick one of the proposed corrections and modify it. The automatically generated transcription alternatives can be accompanied by their audio output symbol representation, which allows for obtaining a verification of the mispronunciation correction at the same time.

The candidate text-to-audio transcriptions can be verified. Verification can include synthesizing the corrected transcriptions and presenting them to a group of listeners in a simple listening test. In one non-limiting example embodiment, the verification can be achieved via crowd-sourcing. Via crowd-sourcing, a primary text-to-speech synthesizer 210-1 can receive feedback indicating whether an audio rendition of a word is correct.

In one embodiment, one or more listeners can decide whether or not the corrected words all sound correct or not. The verification can optionally be applied any of the text-to-speech transcriptions as discussed herein. In one embodiment, an audience of listeners can listen to a text-to-speech transcription produced by a grapheme-to-phoneme algorithm 111-1 and decide whether the proposed best efforts transcription of the out-of-vocabulary word is correctly pronounced.

In accordance with further embodiments, for both Pop-up and/or Evergreen type of out-of-vocabulary words, verified transcriptions can be almost immediately available to clients as lexicon updates when connected to a cloud. In other words, the processing system 200 may be located in a cloud environment. Multiple users can access the processing system 200 to perform text-to-speech services on newsfeeds, e-mails, documents, etc. The verified transcriptions for verified out-of-vocabulary words and corresponding audio output symbol representation can be transmitted to the processing system 200 within a short duration of time (e.g., one hour) after initial detection of a mispronunciation. Updating the processing system 200 with proper pronunciation information for out-of-vocabulary reduces future mispronunciations when the out-of-vocabulary is detected again. For situations where the processing system 200 is not cloud-based, evergreen type of transcriptions can be prepared for inclusion into a next system release.

In accordance with further embodiments, the corrected transcriptions can also serve as input for enhancing/updating a respective processing system 200 grapheme-to-phoneme algorithm. When the grapheme-to-phoneme algorithm is changed or updated, the mispronunciation estimation may need to be re-run. The mispronunciation updates also can be used to update the respective classification model.

According to embodiments herein, mispronunciation estimation and mispronunciation detection can be fully machine-automated. Mispronunciation correction can only be automated for cases when the grapheme-to-phoneme functionality or lexicon of other than the base language can be used. Otherwise, it can involve human intervention. Also the verification of the mispronunciation corrections (when used) may require human judges (e.g., human-in-the-loop).

Figure 5:
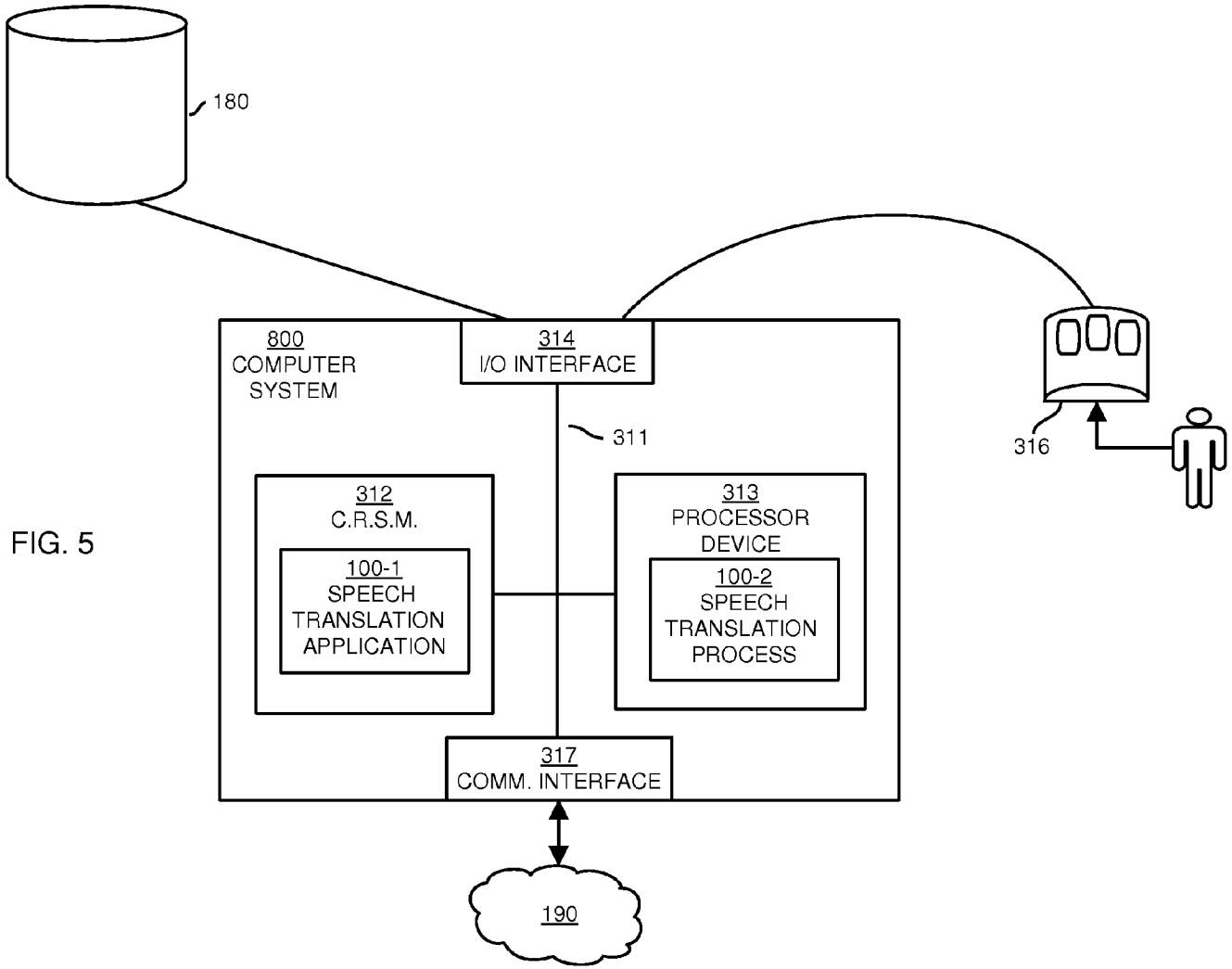
FIG. 5 is an example diagram illustrating an example computer architecture for implementing any of the operations according to embodiments herein.

FIG. 5 is an example block diagram of a computer system for implementing any of the processing as discussed herein.

Computer system 800 can include one or more computerized devices such as a personal computer, workstation, portable computing device, console, network terminal, processing device, network device, etc., operating as a server, client, etc.

Note that the following discussion provides a basic embodiment indicating how to execute functionality associated with resources as discussed herein. However, it should be noted that the actual configuration for carrying out the operations as described herein can vary depending on a respective application.

As shown, computer system 800 of the present example includes an interconnect 311 that couples computer readable storage media 312 such as a non-transitory type of computer readable storage media in which digital information can be stored and retrieved, a processor device 313, I/O interface 314, and a communications interface 317.

I/O interface 314 provides connectivity to repository 180 and, if present, other devices such as display screen, peripheral devices 316, keyboard, computer mouse, etc.

Computer readable storage medium 312 can be any suitable device such as memory, optical storage, hard drive, floppy disk, etc. In one embodiment, the computer readable storage medium 312 is a non-transitory storage media (i.e., hardware storage media) configured to store instructions and/or data.

Communications interface 317 enables the computer system 800 and processor device 313 (e.g., one or more processors) to communicate over a network 190 to retrieve information from remote sources and communicate with other computers. As mentioned, I/O interface 314 enables processor device 313 to retrieve respective information from repository 180.

As shown, computer readable storage media 312 can be encoded with application 100-1 (e.g., software, firmware, etc.) executed by processor device 313.

During operation of one embodiment, processor device 313 accesses computer readable storage media 312 via the use of interconnect 311 in order to launch, run, execute, interpret or otherwise perform the instructions of application 101-1 stored on computer readable storage medium 312. Speech translation application 101-1 can include appropriate instructions, language models, analyzers, etc., to carry out any or all functionality associated with the processing system 100, processing system 200, and/or and mentioned resources as discussed herein.

Execution of the application 101-1 produces processing functionality such as process 101-2 in processor 313. In other words, the process 101-2 associated with processor device 313 represents one or more aspects of executing application 101-1 within or upon the processor device 313 in the computer system 800.

Those skilled in the art will understand that the computer system 800 can include other processes and/or software and hardware components, such as an operating system that controls allocation and use of hardware resources to execute application 101-1.

In accordance with different embodiments, note that computer system may be any of various types of devices, including, but not limited to, a personal computer system, desktop computer, laptop, notebook, netbook computer, mainframe computer system, handheld computer, workstation, network computer, application server, storage device, a consumer electronics device such as a camera, camcorder, set top box, mobile device, video game console, handheld video game device, a peripheral device such as a switch, modem, router, or in general any type of computing or electronic device.

Functionality supported as discussed herein will now be discussed via flowcharts in FIGS. 6-7. As discussed above, the appropriate resources in speech-processing system 100 (e.g., processing system 100-1, processing system 100-2, . . . ) and speech processing system 200 can be configured to execute the steps in the flowcharts as discussed below.

Note that there will be some overlap with respect to concepts discussed above for FIGS. 1 through 5. Also, note that the steps in the below flowcharts need not always be executed in the order shown. That is, the steps can be executed in any suitable order.

Figure 6:
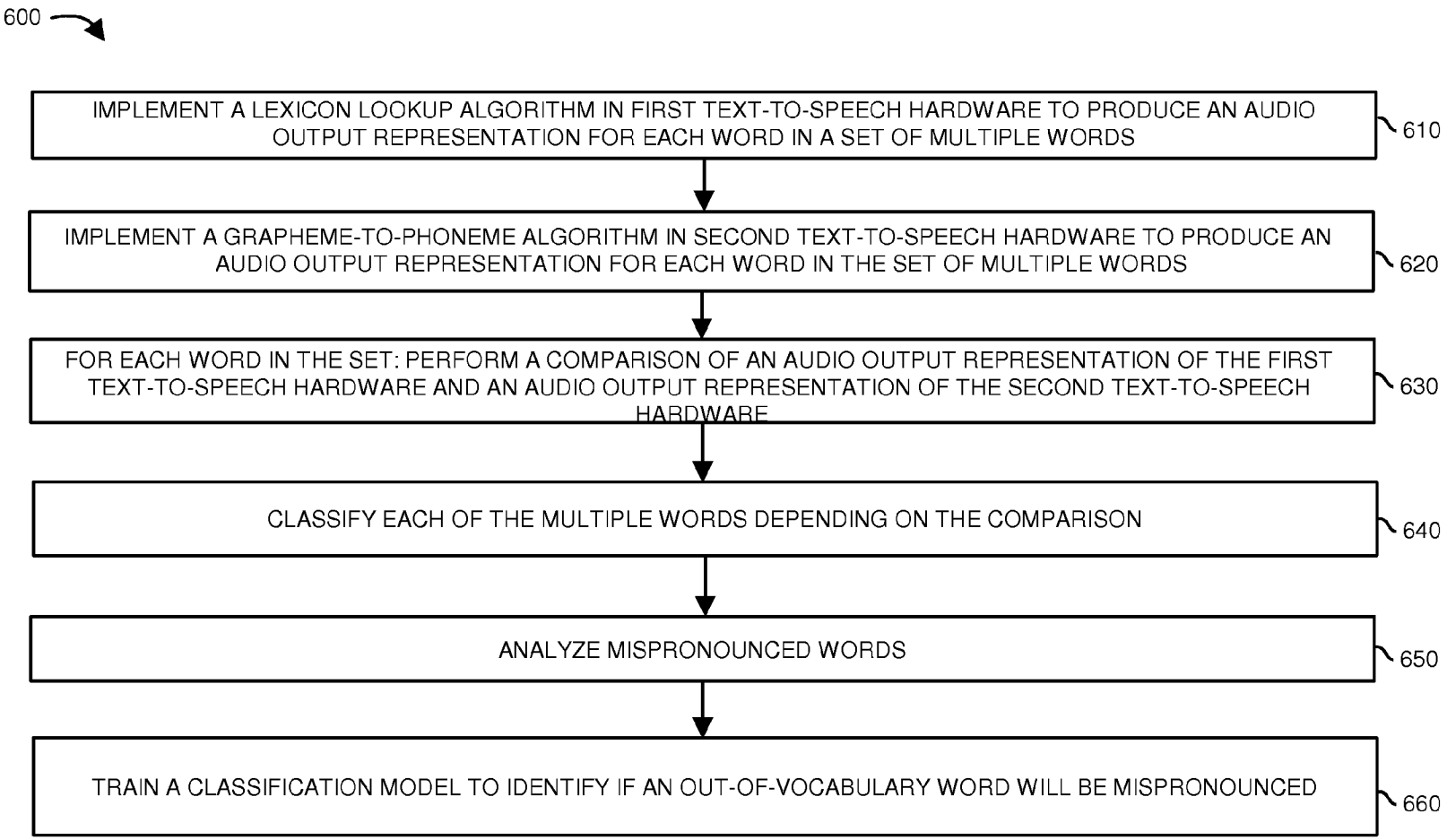
FIGS. 6 and 7 are flowcharts illustrating example methods according to embodiments herein.

FIG. 6 is a flowchart 600 illustrating a general technique of processing text and training a classification model according to embodiments herein.

In processing block 610, the processing system 100-1 implements a lexicon lookup algorithm 110-1 in first text-to-speech synthesizer 115-1 to produce an audio output symbol representation 120-1 for each word in a set of multiple sample words 105-1.

In processing block 620, the processing system 100-1 implements a grapheme-to-phoneme algorithm 111-1 in second text-to-speech synthesizer 115-2 to produce an audio output symbol representation 120-2 for each word in the set of multiple sample words 105-1.

In processing block 630, for each word in the set of sample words 105-1: the comparator resource 125-1 performs a comparison of an audio output symbol representation 120-1 of the first text-to-speech synthesizer 115-1 and an audio output symbol representation 120-2 of the second text-to-speech synthesizer 115-2.

In processing block 640, the comparator resource 125-1 classifies each of the multiple sample words 105-1 depending on the comparison.

In processing block 650, the analyzer resource 160-1 analyzes the mispronounced words in class 151-1 to produce training information 170-1.

In processing block 660, the processing system 100-1 utilizes training information 170-1 to train classification model 175-1 to identify when an out-of-vocabulary word will be mispronounced.

Figure 7:
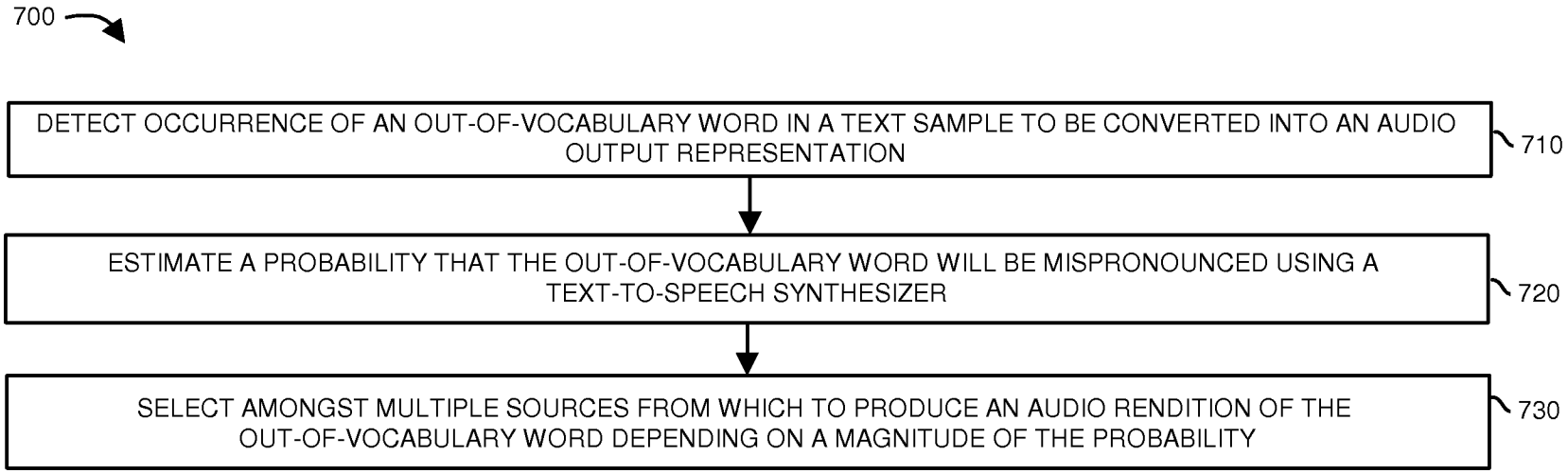

FIG. 7 is a flowchart 700 illustrating text-to-speech synthesis according to embodiments herein.

In processing block 710, the processing system 200 detects occurrence of an out-of-vocabulary word in a text sample 205-1 to be converted into audio output symbol representation 250.

In processing block 720, the processing system 200 estimates a probability that the out-of-vocabulary word will be mispronounced using a text-to-speech synthesizer such as primary text-to-speech synthesizer 210-1.

In processing block 730, the combiner resource 280 of processing system 200 selects amongst multiple sources (e.g., grapheme-to-phoneme rules 111-1, secondary text-to-speech synthesizer 210-2, review resource 260, etc.) from which to produce an audio rendition of the out-of-vocabulary word depending on a magnitude of the probability.

For example, if an out-of-vocabulary word is not detected as a foreign language and the probability of mispronunciation using grapheme-to-phoneme algorithm is high, then the primary text-to-speech synthesizer 210-1 can transmit the out-of-vocabulary word over network 290 to receive an appropriate text-to-speech conversion of the word.

If an out-of-vocabulary word is detected as a foreign language and the probability of mispronunciation using grapheme-to-phoneme algorithm 111-1 is high, then the primary text-to-speech synthesizer 210-1 can use a text-to-speech synthesis of the out-of-vocabulary word in the foreign language as an appropriate text-to-speech conversion of the word.

If an out-of-vocabulary word is detected as a foreign language and the probability of mispronunciation using grapheme-to-phoneme algorithm 111-1 is high, then the primary text-to-speech synthesizer 210-1 can transmit the out-of-vocabulary word over network 290 to receive an appropriate audio output symbol representation conversion of the word.

Figure 8:
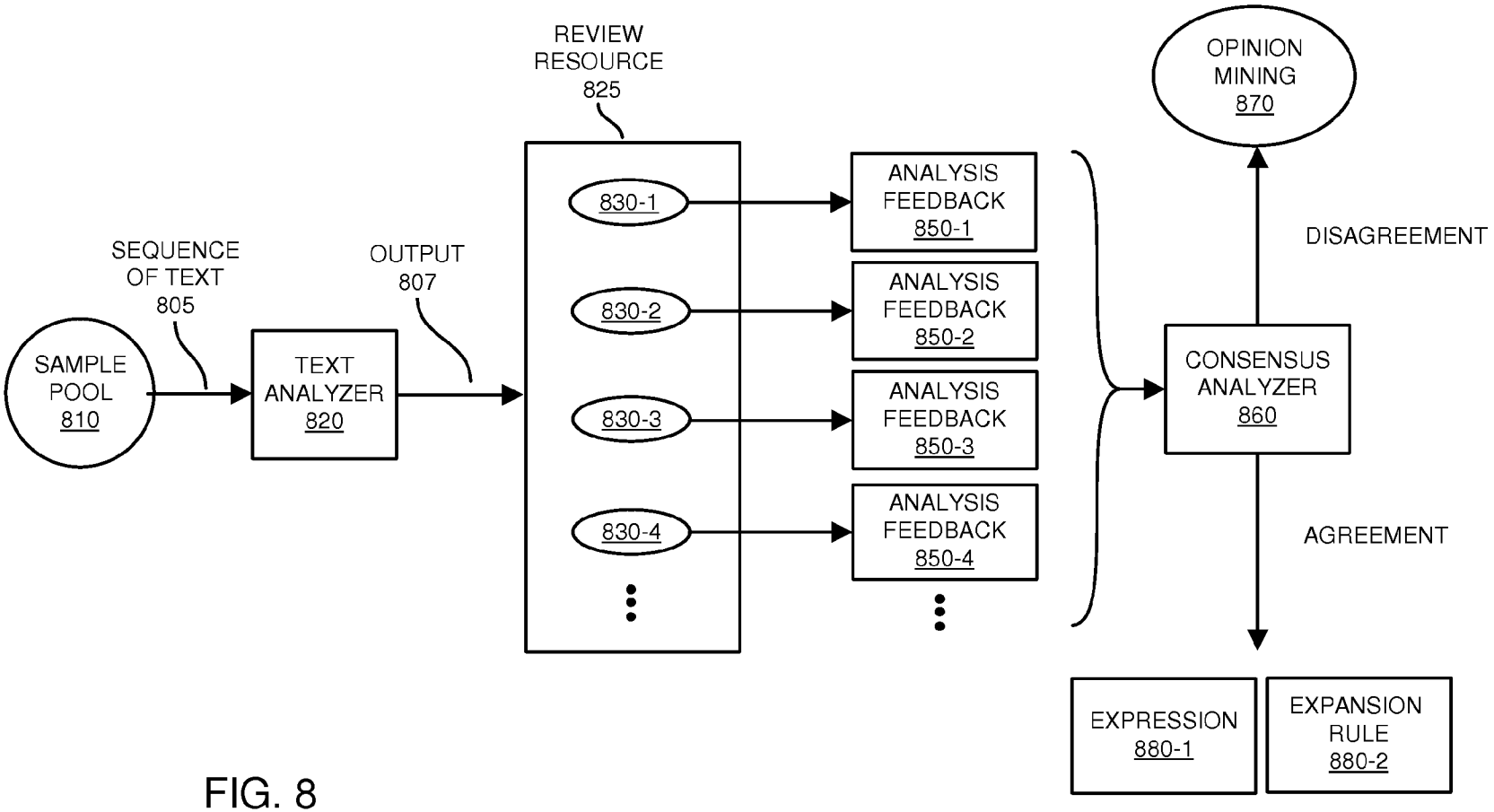
FIG. 8 is an example diagram of a processing system to collect and analyze text samples according to embodiments herein.

FIG. 8 is an example diagram of a processing system to collect and analyze text samples according to embodiments herein.

One concern of customers that purchase text-to-speech synthesizer systems is how can they be sure that the system provides good coverage for text normalization. Based on analysis of proposed expansion of a non-standard word, embodiments herein enable a processing system to determine a probability that a detected non-standard word will be mispronounced during text-to-speech synthesis.

Embodiments herein can be deployed as part of a text-to-speech front-end component release and quality assurance process. After analysis such as discussed herein, if it is determined that proposed expansion rule for a non-standard word is likely to be correct above a threshold value, the proposed expansion rule and expression (to detect occurrences of the non-standard word) can be released to text-to-speech systems (e.g., in the cloud systems, non-cloud systems, etc.).

Embodiments herein can include continuous monitoring (e.g., via crowd-sourcing, human reviewers, etc.) to ensure that non-standard words are expanded into appropriate audio output.

More specifically, data collection and analysis can be employed to improve text normalization quality and its tuning in different domains. The method can includes four parts: initial data collection, evaluation and tagging, test cases growing and quality measurements, and opinion Mining Initial Data Collection In one embodiment, text analyzer 820 analyzes a sample pool 810 such as large text corpora (e.g. news articles, novels, Twitter/SMS, webpages, etc.). In one embodiment, the text analyzer 820 uses a set of rough regular expressions to identify presence of one or more non-standard words in a respective sequence of text 805 received from sample pool 810. The regular expressions to detect occurrence of non-standard word can be supplemented via the system's text normalization rules.

By way of a non-limiting example, an objective of the text analyzer 820 is to identify sequences of non-standard words (NSWs) found in the input texts that are subject to the text normalization (dates, abbreviations, URLs, etc.). The regular expressions do not need to be very accurate. However, they must be general enough to catch different instances of non-standard words.

In one embodiment, the text analyzer 820 tags the word and/or points in the sequence of text 805 suspected of being or including a non-standard word. The text analyzer can tag the sequence of text 805 and/or a specific non-standard word detected in the sequence of text 805.

Text analyzer 820 produces output 807. In one embodiment, output 807 from the text analyzer 820 includes the expression (e.g., rule) used to identify the instance of non-standard word as well as a proposed audio expansion rule for the detected (or tagged non-standard word).

The sentences in sample pool 810 having one or more non-standard words can be filtered to eliminate redundancies in repeating non-standard word patterns. Additionally, it is also possible to skip this manual step of reducing repetitious instances and make a random selection of samples of a sufficient size to perform the analysis.

In accordance with further embodiments, the text analyzer 807 presents output 807 to review resource 825. As shown, review resource 825 can include reviewer 830-1, reviewer 830-2, reviewer 830-3, reviewer 830-4, etc.

Each of the reviewers 830 can be human, machine, etc.

By way of a non-limiting example, the text analyzer 820 presents the pre-tagged selected sequence of text 805 and a proposed text-to-speech audio output for a tagged non-standard word to human judges. In a specific embodiment, the text analyzer 820 or other suitable resource presents the tagged sequence of text (non-standard word) and corresponding proposed audio rendition for the instance non-standard word to at least one reviewer. As discussed below, the at least one reviewer provides feedback to consensus analyzer 860. In one embodiment, the feedback indicates whether expansion of the instance of the non-standard word is correctly pronounced using the corresponding proposed audio expansion rule.

In one embodiment, the reviewers perform fine-grain tagging. For example, if the initially tagged portion of the sequence of text 805 does not correctly identify the portion of the sentence representing the non-standard word, the reviewers can fine-tune the tagging to indicate the portion that represents the non-standard word.

In accordance with further embodiments, the reviewers can categorize the newly detected non-standard words according to a pre-defined taxonomy, and decide on correctness of a corresponding pronunciation of the non-standard word at two levels—Expansion and Prosody. Expansion aims at correctness of the conversion of the input non-standard words tokens into words. Prosody aims at correctness of prosodic realization and includes aspects like phrasing or stress positioning.

When human reviewers are used, human judges can be required to take a qualification test consisting of references prepared by experts. If the human reviewers prove their ability to analyze non-standard words, they can be used to perform analysis as discussed herein.

In accordance with further embodiments, each of reviewers 830 produces a corresponding analysis feedback 850 of a non-standard word being examined. The feedback analysis can include a determination whether a proposed text expansion and audio output assigned to the tagged non-standard word is correct.

As previously discussed, analysis by a reviewer can fine tag the non-standard word in the sequence of text 805 if the original tag of the non-standard word is incorrect. Based on the feedback from the one or more reviewers, embodiments herein can include producing a fine-grained expression for the instance of the non-standard word. An expression (e.g., rule) to detect occurrences of the non-standard word can be modified depending on the feedback.

In additional embodiments, note that the one or more reviewers 830 can provide a proposed expansion of the non-standard word into a sequence of one or more words that represent the tagged non-standard word.

In this example embodiment, reviewer 830-1 analyzes output 807 (such as detected non-standard word, surrounding text, proposed audio expansion, initial expression used to detect the non-standard word, etc.) and produces feedback analysis 850-1; reviewer 830-2 analyzes output 807 and produces feedback analysis 850-2; reviewer 830-3 analyzes output 807 and produces feedback analysis 850-3; reviewer 830-4 analyzes output 807 and produces feedback analysis 850-4, and so on.

The consensus analyzer 860 analyzes feedback analysis 850 (e.g., feedback analysis 850-1, feedback analysis 850-2, feedback analysis 850-3, feedback analysis 850-4, etc.) to determine whether the reviewers are in agreement with respect to one or more analyzed parameters. For example, the consensus analyzer 860 can be configured to detect a degree to which the reviewers 830 agree as how to audibly expand the tagged non-standard word in the sequence of text 805.

If the consensus analyzer 860 does not detect agreement for a tagged non-standard word above a threshold value (such as 4 or more out of 5 reviewers), the consensus analyzer 860 can forward the non-standard word (e.g., sequence of letters, symbols, numbers, etc.) to opinion mining 870, in which another population of reviewers determines what is meant by the non-standard word. Thus, for cases in which the one or more reviewing listeners do not find an agreement regarding correctness of audio expansion for a non-standard word or a non-standard word is found to be wrongly expanded, the case are considered to be subjective and in need of further analysis.

Based on the agreement results, embodiments herein can include generating a first text normalization quality metric (e.g., 80% if 4 out of 5 reviewers indicates that audio expansion for a non-standard word is correct). This metric represents accuracy of handling of unique text normalization formats. The metric can indicate a degree to which the reviewers agree or disagree.

An example of a tagged non-standard word where there may be disagreement is a so-called smiley face symbol often used in e-mails. The text analyzer 820 may tag the instance of the smiley symbol (as a non-standard word) and propose how to audibly expand the smiley symbol. In such an instance, the one or more reviewers 830 can be presented with the challenge of reviewing the detected non-standard word (such as the smiley face). The reviewers may not agree as to how to audibly expand the smiley face when converting the smiley face into audio during text-to-speech synthesis.

For example, via feedback analysis 850-1, the reviewer 830-1 may propose to play back laughter when performing text-to-speech synthesis on the smiley face; via feedback analysis 850-2, the reviewer 830-2 may propose to play back tweeting birds when performing text-to-speech synthesis on the smiley face; via feedback analysis 850-3, the reviewer 830-3 may propose to audibly play back the words "smiley face" for the tagged smiley face symbol; and so on.

In this example, because the disagreement is above a threshold value (e.g., no reviewers agree), the consensus analyzer 860 forwards the case to opinion mining 870.

Thus, the sequences including non-standard words for which the reviewing listeners do not find a good agreement regarding their correctness during tagging and evaluation stages are considered to be subjective or not having sufficient context for disambiguation. In certain instances as mentioned, if the expansion proposed by the text analyzer 820 is improper, the case can be forwarded to opinion mining 870.

As an alternative, as mentioned, the reviewers can be tasked to produce a fine-grained expression audio output respective expansion rule for the detected instance of the non-standard word. The fine-grained expression (such as an updated rule indicating how to identify a respective non-standard word) or the original regular expression can be used to identify multiple instances of the non-standard word in an additional text sample received from multiple sources.

In accordance with further embodiments, a crowd-sourcing technique can be used to obtain statistics regarding the possible expansions of the detected non-standard words. It may be possible to indicate that a given input text does not contain enough information for disambiguating. These cases are then collected in a special set for potential analysis by experts.

Test Cases Growing and Quality Tracking

By way of a non-limiting example, the fine-tagged sentences resulting from the evaluation and tagging analysis as discussed above can be used as input for semi-automated generation of regular expressions or adopting the system's TN component (hereafter referred to as FineNSWsTagger). The set of tagged sentences will be hereafter called TestCases.

The sentences matched by the NSWsTagger can be re-analyzed using the FineNSWsTagger. Matched sentences can be used to calculate text normalization quality estimates for different taxonomy classes (e.g., a second TN quality metric). Note that each subpart of the FineNSWsTagger (e.g. each regular expression) has an indexed taxonomy class to which it relates. Upon the analysis of the tagged data on hand, each non-standard word's pattern is assigned a probability of being mishandled by the system.

The FineNSWsTagger can be applied for analyzing new texts. These texts can for example be obtained by web scraping tools. In one embodiment, the goal is to measure frequency of occurrences of different non-standard word patterns in different text domains (e.g., sports, finance, entertainment, etc.) coming from different sources and using store accuracy information to estimate probability of appearance of a text normalization mishandling in a given context. These estimates can be done on a continuous basis and define another TN quality metric.

In one embodiment, the TestCases are used as a so-called "gold standard" for testing the text normalization component of the system upon possible modifications. This is especially useful for regression testing as part of the release process of the text-to-speech front-end component. Regression testing can include iteratively monitoring new text sources for instances of a non-standard word and verifying (using reviewers) whether an expansion rule is correct.

The processing as discussed herein can be run on a continuous basis. The set of analyzed domains in which a non-standard word may be used can be extended at any time to track how a particular non-standard word is used in different contexts. In one embodiment, the text normalization quality metrics are tracked continuously. It is possible to automatically predict accuracy of the text normalization component such as the portion of a text-to-speech process that uses an expression to identify non-standard words and corresponding expansion rule to produce an audio output for the non-standard words.

As discussed above, the reviewer resource 825 and one or more reviewers 830 generates analysis 850 indicating whether there is agreement as to how to expand a detected non-standard word. In this example, expression 880-1 represents a rule that is used to detect occurrence of a non-standard word. The expansion rule 880-2 (associated with the expression 880-1) indicates how to expand the corresponding non-standard word into audio.

In accordance with embodiments herein, note that the review resource 825 and/or opinion mining 870 can be used to produce the expression 880-1 and expansion rule 880-2 for the detected instance of the non-standard word. The expression 880-1 may also be the regular expression used by the text analyzer 820 to detect presence of the non-standard word in sequence of text 805. One or more reviewers 830 may be in agreement that the original expression (e.g., regular expression) used by the text analyzer 820 to detect occurrence of the non-standard word and corresponding expansion may be correct.

Thus, the expression 880-1 and corresponding expansion rule 880-2 can be the same or modified version of the expression 880-1 and expansion rule 880-2 depending on feedback analysis 850. In other words, the one or more reviewers can convene or collaborate to produce an expression and corresponding expansion rule.

Figure 9:
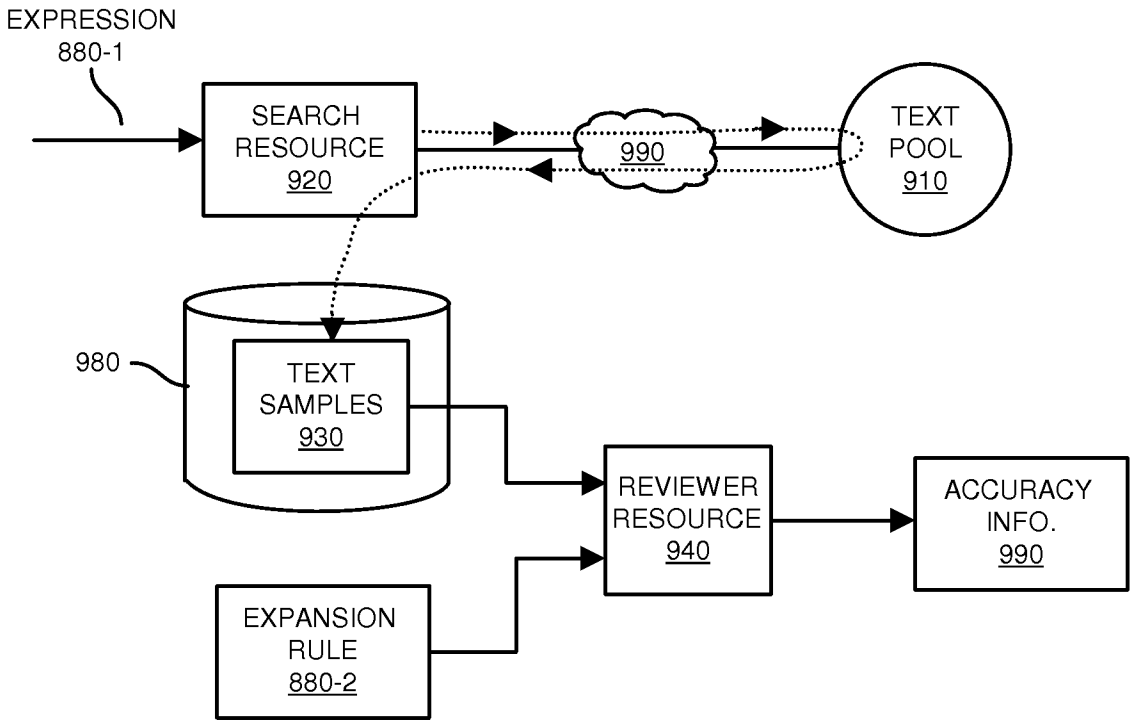
FIG. 9 is an example diagram illustrating further analysis of non-standard word according to embodiments herein.

FIG. 9 is an example diagram illustrating further analysis of a proposed expression and expansion rule according to embodiments herein.

As shown, search resource 920 receives the proposed expression 880-1. As previously discussed, the particular expression 880-1 serves as a basis to identify occurrence of a particular non-standard word in text samples.

In one embodiment, the search resource 920 utilizes the expression 880-1 to identify additional instances of the particular non-standard word in text pool 910. The search resource 920 can communicate over a network 990 such as the Internet to access (e.g., document, webpages, newsfeeds, etc.) to identify text samples (e.g., sentences, paragraphs, etc.) that include an occurrence of the particular non-standard word. The search resource 920 also can process locally available text to find example text including a non-standard word.

In this example, the search resource 920 stores the text samples 930 including the particular non-standard word in repository 980.

Further embodiments herein can include presenting the text samples 930 and corresponding expansion rule 880-2 to reviewer resource including one or more reviewers (e.g., human reviewers, machine reviewers, etc.). Based on a respective textual context in which the particular non-standard word is used, the reviewers (i.e., reviewer resource 940) make a determination whether the expansion (via expansion rule 880-2) into corresponding audio assigned to the particular non-standard word is correct. The reviewer resource 940 repeats this process for large sample of instances to determine how accurate the expansion rule 880-2 is for the detected non-standard words in the text samples 930.

In one embodiment, the reviewer resource 940 records an accuracy of the expansion rule 880-2 for the instances of the particular non-standard word. As an example, assume that text samples 930 include two hundred samples of sentences including the particular non-standard word as detected by application of expression 880-1.

Assume further that the review resource 940 determines that the expansion rule 880-2 (e.g., expansion into particular audio) is correct only one hundred and sixty two times out of the two hundred instances. The expansion rule applied to instances of non-standard words detected by expression 880-1 is therefore only 81% correct. This review information is stored as accuracy information 990.

A probability of correction for a given expansion rule may converge on a value. For example, when enlarging the sample, the accuracy may converge to a value such as 81%.

Upon subsequent analysis of the text normalization component in a text-to-speech system, it is possible to determine a degree to which a given non-standard word in a document can be converted into proper audio. For example, if a document includes an instance of the particular non-standard word, the probability that the expansion will be correct using expansion rule 880-2 is 81%.

If the probability of correctness converges to a value above a threshold value such as over 80%, the expansion rule and expression can be distributed to update text-to-speech synthesizers. In this instance, the expression 880-1 and corresponding expansion rule 880-2 can be distributed to one or more text-to-speech systems.

If the probability of correctness converges on a value below a threshold value such as 80%, then continued sampling can be performed to determine different contexts in which the particular non-standard word is used.

Note that the particular non-standard word may need to be expanded into different words and corresponding audio depending on the content of the non-standard word. In such an instance, as discussed below, the expansion rule can be updated to account for different audio expansion of the particular non-standard word depending on the context in which the non-standard word is detected.

Figure 10:
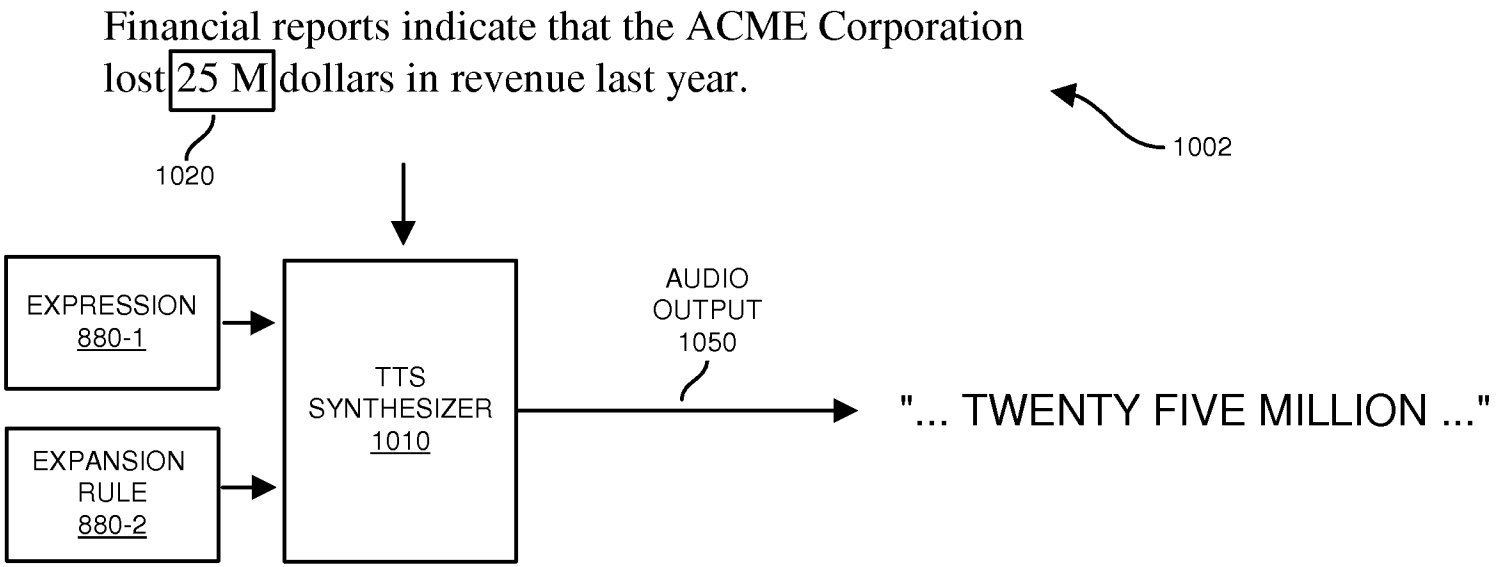
FIG. 10 is an example diagram illustrating text-to-speech expansion of a non-standard word in a first context according to embodiments herein.

FIG. 10 is an example diagram illustrating expansion of a non-standard word according to embodiments herein.

Assume in this example that text-to-speech synthesizer 1010 receives the text phrase 1002 to convert into a corresponding audio output 1050. The text phrase 1002 may be part of an article, novel, e-mail, etc., converted for a subscriber into corresponding audio output 1150. The text-to-speech synthesizer 1010 utilizes the verified expression 880-1 (e.g., a rule indicating that a number or digit followed by the letter M is a non-standard word) to detect non-standard word 1020 (e.g., "25 M"). Assume that each of the words in the text phrase 1002 other than the non-standard word 1020 can be synthesized into corresponding output via a lexicon lookup algorithm.

In this example embodiment, the text-to-speech synthesizer 1010 uses the expansion rule 880-2 to expand the detected non-standard word 1020.

The text-to-speech synthesizer 1010 can be configured to determine a context in which the non-standard word is used based on words located in a vicinity of the non-standard word 1020, topic of article in which the text phrase 1002 appears, etc.

Assume in this example that, via context analysis, the text-to-speech synthesizer 1010 detects that the text phrase 1002 pertains to the topic of finance. Assume further that the expansion rule 880-2 indicates to expand the letter "M" into the audible sound "million" when the detected non-standard word is used in the topic of finance.

Accordingly, based on the expansion rule 880-2 in this instance, the text-to-speech synthesizer expands the non-standard word 1002 (e.g., "25 M") into the audible sound "twenty five million" during text-to-speech conversion.

Figure 11:
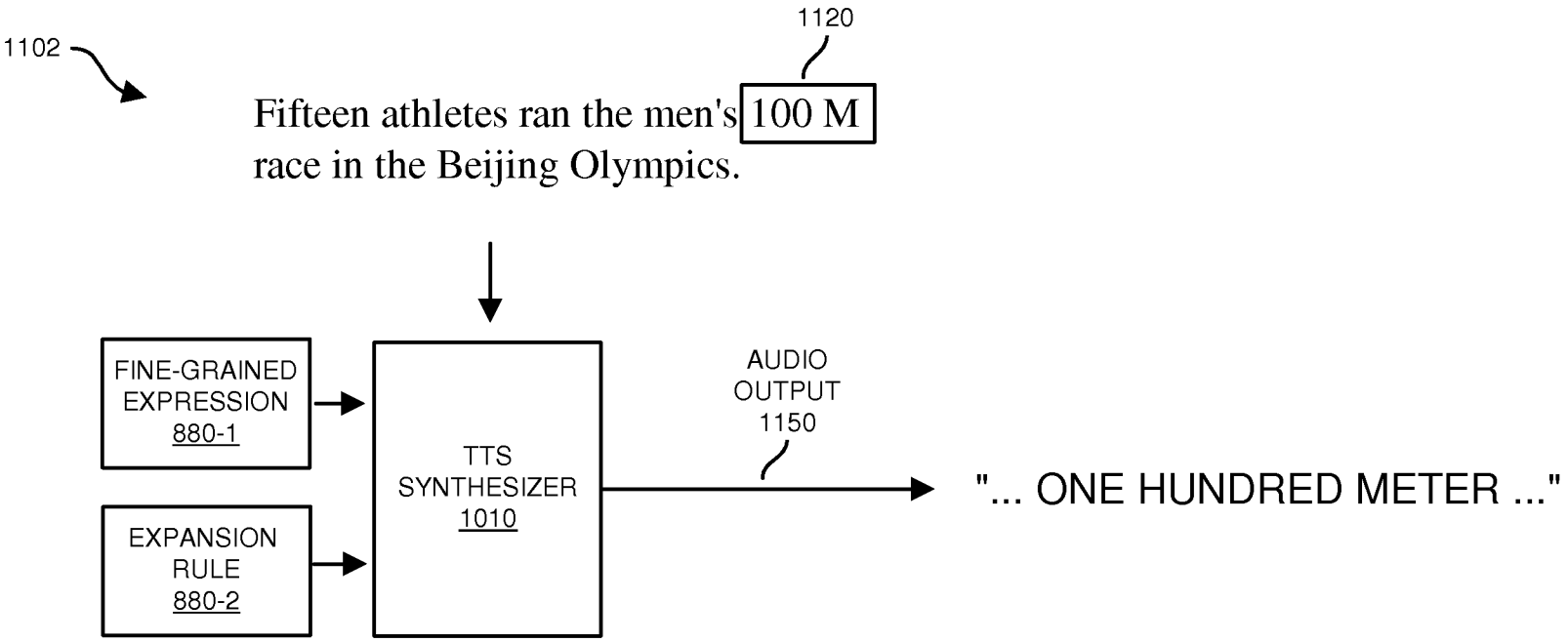
FIG. 11 is an example diagram illustrating text-to-speech expansion of a non-standard word in a second context according to embodiments herein.

FIG. 11 is an example diagram illustrating expansion of a non-standard word in a second context according to embodiments herein.

Assume in this example that text-to-speech synthesizer 1010 receives the text phrase 1102 to convert into a corresponding audio output 1150. The text phrase 1102 may be part of an article, elemental mercury, novel, etc., converted for a subscriber into corresponding audio output 1150.

The text-to-speech synthesizer 1010 utilizes the expression 880-1 (e.g., a rule indicating that a number or digit followed by the letter M is a non-standard word) to detect non-standard word 1020 (e.g., "100 M"). Assume that each of the words in the text phrase 1102 other than the non-standard word 1120 can be synthesized into corresponding output via a lexicon lookup algorithm.

In this example embodiment, the text-to-speech synthesizer 1010 uses the expansion rule 880-2 to expand the detected non-standard word 1120. As previously discussed, the text-to-speech synthesizer 1010 can be configured to determine a context in which the non-standard word 1120 is used based on words located in a vicinity of the non-standard word 1120, topic of article in which the text phrase 1102 appears, etc.

Assume in this example that, via context analysis, the text-to-speech synthesizer 1010 detects that the text phrase 1102 is used in the topic of sports. Assume further that the expansion rule 880-2 indicates to expand the letter "M" into the audible sound "million" when the detected non-standard word is used in the topic of sports.

Accordingly, based on the expansion rule 880-2 in this instance, the text-to-speech synthesizer expands the non-standard word 1102 (e.g., "100 M") into the audible sound "one hundred meters" during text-to-speech conversion.

The expansion rule 880-2 can be split into two rules; each rule is used in a different context. In such an embodiment, the processing system as discussed herein can generate a first text-to-audio expansion rule indicating how to expand the non-standard word into first corresponding audio in a first textual context of using the non-standard word. The processing system can generate a second text-to-audio expansion rule indicating how to expand the non-standard word into second corresponding audio in a second context of using the non-standard word.

Figure 12:
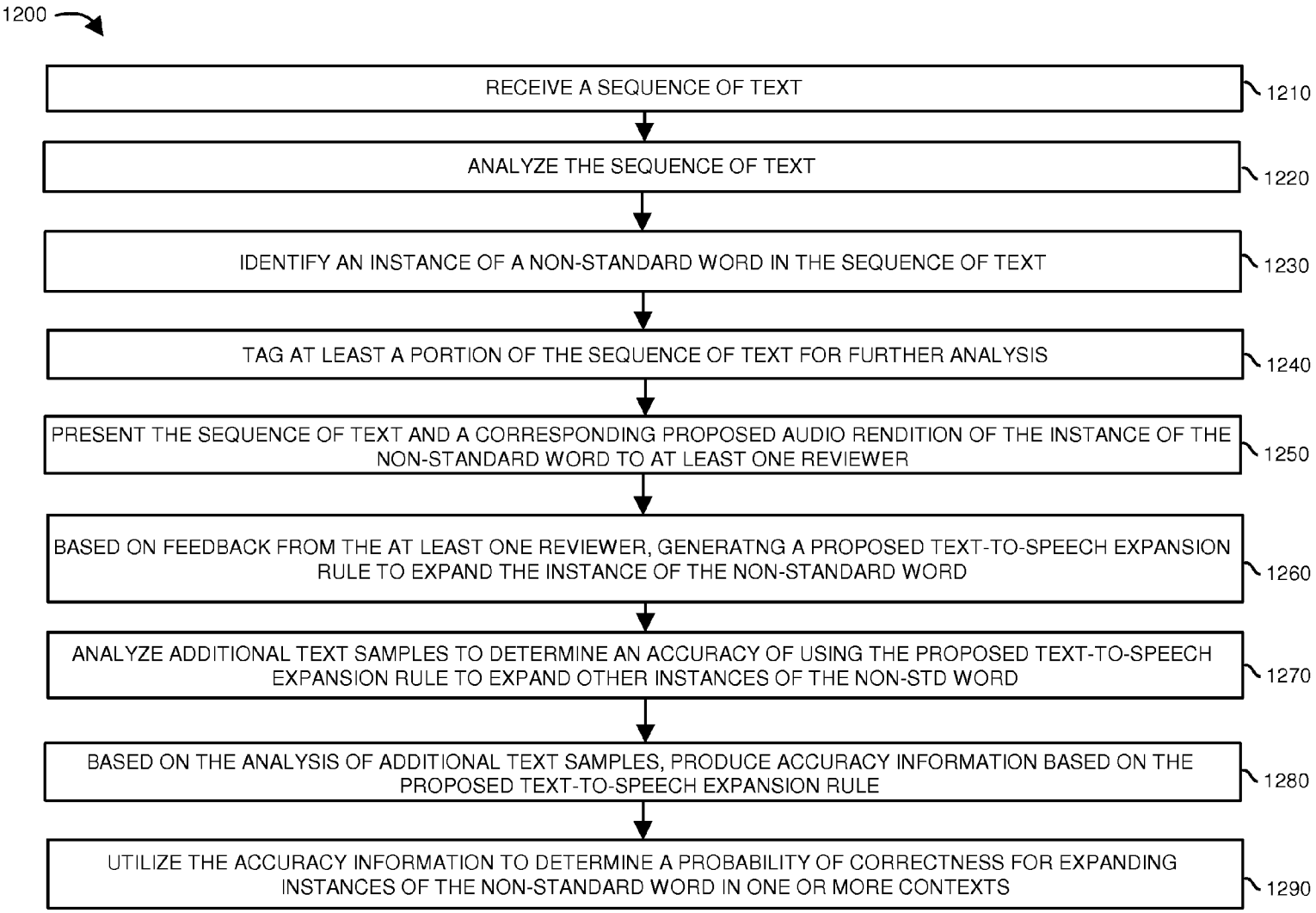
FIG. 12 is a flowchart illustrating an example method according to embodiments herein.

FIG. 12 is a flowchart illustrating an example method according to embodiments herein.

In processing block 1210, the text analyzer 820 receives a sequence of text 805.

In processing block 1220, the text analyzer 820 analyzes the sequence of text 805.

In processing block 1230, the text analyzer 820 identifies an instance of a non-standard word in the sequence of text 805.

In processing block 1240, the text analyzer 820 tags at least a portion of the sequence of text 805 for further analysis.

In processing block 1250, the text analyzer 820 presents the sequence of text 805 and a corresponding proposed audio rendition of the detected non-standard word to one or more reviewer. In one embodiment, expansion rule 880-2 indicates how to expand instances of a respective non-standard word.

In processing block 1260, the search resource 920 analyzes additional text samples including the non-standard word to determine an accuracy of using the proposed text-to-speech expansion rule 880-2.

In processing block 1270, the reviewer resource 940 analyzes the additional text samples and instances of the non-standard word to determine an accuracy of the proposed text-to-speech expansion rule.

In processing block 1280, based on the analysis of additional text samples, the review resource 940 produces and stores accuracy information 990 based on application of the text-to-speech expansion rule for the non-standard word.

In processing block 1290, a text-to-speech processing system utilizes the accuracy information 990 to determine a probability of correctness for expanding instances of a particular non-standard word (as detected via expression 880-1) into one or more different contexts.

Based on the description set forth herein, numerous specific details have been set forth to provide a thorough understanding of claimed subject matter. However, it will be understood by those skilled in the art that claimed subject matter may be practiced without these specific details. In other instances, methods, apparatuses, systems, etc., that would be known by one of ordinary skill have not been described in detail so as not to obscure claimed subject matter. Some portions of the detailed description have been presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm as described herein, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a computing platform, such as a computer or a similar electronic computing device, that manipulates or transforms data represented as physical electronic or magnetic quantities within memories, registers, or other information storage devices, transmission devices, or display devices of the computing platform.

While this invention has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting. Rather, any limitations to the invention are presented in the following claims.

What is claimed is:

1. A method comprising:

detecting, by at least one processor, occurrence of an out-of-vocabulary word in a text sample;

detecting a likelihood that the out-of-vocabulary word will be mispronounced using a primary text-to-speech synthesizer associated with a primary language;

receiving feedback from a source other than the primary text-to-speech synthesizer, the feedback indicating a conversion in accordance with a secondary language of the out-of-vocabulary word into a corresponding audio output;

storing the feedback in a repository:

generating, based on the feedback and by a secondary text-to-speech synthesizer associated with the secondary language, a first audio pronunciation of the out-of-vocabulary word pronounced in accordance with a native secondary language speaking person speaking the secondary language; and generating, in accordance with a native primary language speaking person speaking the primary language, a second audio pronunciation of the out of vocabulary word.

2. The method as in claim 1, wherein the occurrence is a first occurrence of the out-of-vocabulary word, the method further comprising:

detecting a second occurrence of the out-of-vocabulary in a subsequent text sample;

accessing the feedback in the repository; and determining, based on a setting associated with the second text-to-speech synthesizer, whether to provide the first audio pronunciation of the out-of-vocabulary word or the second audio pronunciation of the out-of-vocabulary word.

3. The method as in claim 1, wherein the primary text-to-speech synthesizer converts the text sample in accordance with the primary language; and wherein the feedback indicates conversion of the out-of-vocabulary word into a corresponding audio output in accordance with a foreign language with respect to the primary language.

4. The method as in claim 1, wherein receiving the feedback includes:

receiving the feedback from a human reviewer that provides the conversion of the out-of-vocabulary word into the corresponding audio output.

5. The method as in claim 1, further comprising:

initiating distribution of the feedback in the repository over a network to each of multiple remotely located text-to-speech synthesizer systems, each of the remotely located text-to-speech synthesizers configured to convert respective text samples for respective clients that access the remotely located text-to-speech synthesizers.

6. The method as in claim 1, wherein detecting the likelihood that the out-of-vocabulary word will be mispronounced using the primary text-to-speech synthesizer includes:

implementing the primary text-to-speech synthesizer in a first language, the out-of-vocabulary word being absent from a lexicon lookup of the first language.

7. The method as in claim 6, wherein receiving the feedback includes:

analyzing the out-of-vocabulary word via a secondary text-to-speech synthesizer that attempts to convert the out-of-vocabulary in a foreign language with respect to the first language; and producing the feedback in response to detecting that the out-of-vocabulary word is present in a lexicon lookup used by the secondary text-to-speech synthesizer to convert text into speech.

8. A method comprising:

implementing, by at least one processor, a lexicon lookup algorithm via first text-to-speech hardware to produce a first audio output for each word in a set of multiple words comprising one or more words from a base language and one or more words from a foreign language;

implementing a grapheme-to-phoneme algorithm comprising one or more grapheme-to-phoneme rules via second text-to-speech hardware to produce a second audio output for each word in the set of multiple words;

comparing the first audio output and the second audio output by analyzing instances in which the lexicon lookup algorithm produces a different audio output than the grapheme-to-phoneme algorithm for respective text; and generating a set of predictors based on the comparing, the set of predictors indicating circumstances in which use of the one or more grapheme-to-phoneme rules results in identifying one or more audio output representations that correspond to one or more words from the foreign language.

9. The method as in claim 8, further comprising:

classifying each of the multiple words by:

generating a first class of words to include each respective word of the multiple words in which the lexicon lookup algorithm and the grapheme-to-phoneme algorithm produce a substantially different audio output representation; and generating a second class of words to include each respective word of the multiple words in which the lexicon lookup algorithm and the grapheme-to-phoneme algorithm produce a substantially same audio output representation; and generating the set of predictors based on the classifying.

10. The method as in claim 8, further comprising:

for each of the multiple words:

selecting a word from the multiple words;

utilizing the first text-to-speech hardware to generate a first audio output representative of the selected word;

utilizing the second text-to-speech hardware to generate a second audio output representative of the selected word;

comparing the first audio output to the second audio output representation; and classifying the respective first audio output and the second audio output as being either substantially the same or substantially different.

11. The method as in claim 8, wherein the set of predictors indicating indicate circumstances in which use of the one or more grapheme-to-phoneme rules results in generation of substantially different audio output representations by the lexicon lookup algorithm and by the grapheme-to-phoneme algorithm.

12. The method as in claim 11, further comprising:

utilizing the set of predictors to train a classification model.

13. The method as in claim 12, further comprising:

receiving a text sample on which to perform text-to-speech synthesis; and utilizing the classification model to detect which out-of-vocabulary words in the text sample are likely to be mispronounced during the text-to-speech synthesis of the text sample.

14. The method as in claim 9, further comprising:

identifying which subset of the multiple words the lexicon lookup algorithm produces a different audio output than the grapheme-to-phoneme algorithm;

analyzing the subset of words to identify instances in which the grapheme-to-phoneme algorithm produces an improper audio output for words in the subset;

producing a set of rules based on the instances; and utilizing the set of rules to train a classification model, the classification model configured to detect which out-of-vocabulary words in a future received text sample are likely to be mispronounced during text-to-speech synthesis of the text sample.

15. The method as in claim 14, further comprising:

receiving a text sample on which to perform text-to-speech synthesis; and utilizing the classification model to detect which out-of-vocabulary words in the text sample are likely to be mispronounced during the text-to-speech synthesis of the text sample.

16. A method comprising:

detecting, by at least one processor, occurrence of an out-of-vocabulary word in a text sample to be converted into audio output by detecting that the out-of-vocabulary word is not located in a lexicon associated with a default language;

determining a probability that the out-of-vocabulary word will be mispronounced using a text-to-speech synthesizer;

in response to the probability that the out-of-vocabulary word will be mispronounced being below a first threshold probability, producing, via a first text-to-speech synthesizer configured to generate audio in accordance with the default language, a first audio output of the entire out-of-vocabulary word and any words in the text sample that are located in the lexicon associated with the default language; and in response to the probability that the out-of-vocabulary word will be mispronounced meeting a second threshold probability, producing, via a second text-to-speech synthesizer configured to generate audio in accordance with a foreign language, a second audio output of the out-of-vocabulary word.

17. The method as in claim 16 further comprising:

utilizing the first text-to-speech synthesizer to produce an audio output of at least one word other than the out-of-vocabulary word in the text sample;

utilizing the second text-to-speech synthesizer to produce the second audio output of the out-of-vocabulary word; and combining the audio output of the at least one word and the second audio output of the out-of-vocabulary word to produce an audio output.

18. The method as in claim 16, wherein the second audio output of the out-of-vocabulary word comprises an audio pronunciation of the out-of-vocabulary word pronounced in accordance with a native default language speaking person speaking the default language.

19. The method as in claim 16, wherein detecting occurrence of the out-of-vocabulary word in the text sample includes:

performing a morpho-syntactic analysis to one or more words in the text sample to detect the out-of-vocabulary word.

20. The method as in claim 16, wherein the second audio output of the out-of-vocabulary word comprises an audio pronunciation of the entire out-of-vocabulary word pronounced in accordance with a native foreign language speaking person speaking the foreign language.

* * * * *